US008132887B2

(12) United States Patent
Friedman et al.

(10) Patent No.: US 8,132,887 B2
(45) Date of Patent: Mar. 13, 2012

(54) UNIVERSAL CLOSED LOOP COLOR CONTROL

(75) Inventors: Michael Friedman, Windsor, NJ (US); Manojkumar Patel, Princeton Junction, NJ (US); Piyushkumar Patel, Hamilton, NJ (US)

(73) Assignee: Innolutions, Inc., Windsor, NJ (US)

( * ) Notice: Subject to any disclaimer, the term of this patent is extended or adjusted under 35 U.S.C. 154(b) by 227 days.

(21) Appl. No.: 12/660,634

(22) Filed: Mar. 2, 2010

(65) Prior Publication Data

US 2011/0216120 A1 Sep. 8, 2011

(51) Int. Cl.
*B41J 29/393* (2006.01)

(52) U.S. Cl. ..... 347/19; 347/5; 347/14

(58) Field of Classification Search ..... 347/5, 6, 347/9, 14, 15, 19, 20
See application file for complete search history.

(56) References Cited

U.S. PATENT DOCUMENTS

| | | | | |
|---|---|---|---|---|
| 5,285,297 | A | 2/1994 | Rose et al. | 358/518 |
| 5,339,176 | A | 8/1994 | Smilansky et al. | 358/504 |
| 5,543,922 | A | 8/1996 | Runyan et al. | 356/402 |
| 5,724,259 | A | 3/1998 | Seymour et al. | 364/526 |
| 5,781,206 | A | 7/1998 | Edge | 347/19 |
| 5,786,908 | A | 7/1998 | Liang | 358/518 |
| 5,791,249 | A | 8/1998 | Quadracci | 101/450.1 |
| 5,877,787 | A | 3/1999 | Edge | 347/19 |
| 5,967,049 | A | 10/1999 | Seymour et al. | 101/484 |
| 5,967,050 | A | 10/1999 | Seymour | 101/484 |
| 5,992,318 | A | 11/1999 | DiBello et al. | 101/181 |
| 6,027,201 | A | 2/2000 | Edge | 347/19 |
| 6,058,201 | A | 5/2000 | Sikes et al. | 382/112 |
| 6,318,260 | B1 | 11/2001 | Chu et al. | 101/365 |
| 6,480,299 | B1 | 11/2002 | Drakopoulos et al. | 358/1.9 |
| 6,621,585 | B1 | 9/2003 | Patel et al. | 358/1.12 |
| 7,008,036 | B2 * | 3/2006 | Ju et al. | 347/19 |
| 7,059,701 | B2 * | 6/2006 | Deer et al. | 347/19 |
| 7,187,472 | B2 | 3/2007 | Friedman et al. | 358/1.9 |
| 7,477,420 | B2 | 1/2009 | Friedman et al. | 73/10 |
| 7,551,315 | B2 | 6/2009 | Hoshii et al. | 358/1.9 |
| 2001/0048529 | A1 | 12/2001 | Fotland | 358/1.9 |
| 2005/0190389 | A1 | 9/2005 | Tanaka | 358/1.9 |
| 2005/0226466 | A1 | 10/2005 | Seymour | 382/112 |
| 2006/0055948 | A1 | 3/2006 | Ozaki et al. | 358/1.9 |

FOREIGN PATENT DOCUMENTS

| | | |
|---|---|---|
| JP | 10-175290 | 6/1998 |
| JP | 11-165398 | 6/1999 |
| WO | WO 95/11806 | 5/1995 |

* cited by examiner

*Primary Examiner* — Juanita D Jackson
(74) *Attorney, Agent, or Firm* — Roberts & Roberts, LLP

(57) ABSTRACT

A system and processes for the accurate measurement and control of image color values on a printing press with or without the presence of a color bar. More particularly, a universal closed loop color control system and processes for controlling the color quality of color images printed on a substrate online or offline, with or without a color bar printed on the substrate. The system may be run in a "Color Bar Mode" and scan simple rectangular color patches corresponding to each ink key in the print units, or can run in "Gray Spot Mode" and maintain overall target ink density values on the substrate as well as gray balance if the job has critical half tone images, or if the color bar is obtrusive on the job.

20 Claims, 12 Drawing Sheets

UNIVERSAL CLOSED LOOP COLOR CONTROL

CD-ROM APPENDIX

The computer program listing appendix referenced, included and incorporated in the present application is included in a single CD-ROM appendix labeled "UNIVERSAL CLOSED LOOP COLOR CONTROL", which is submitted in duplicate. The CD-ROM appendix includes 115 files. The computer program is incorporated herein by reference.

BACKGROUND OF THE INVENTION

1. Field of the Invention

The present invention relates to a system for the accurate measurement and control of image color values on a printing press with or without the presence of a color bar. More particularly, the invention provides a universal closed loop color control system and processes for controlling the color quality of color images printed on a substrate online or offline, with or without a color bar printed on the substrate.

2. Description of the Related Art

Color perception of a printed image by the human eye is determined by the light reflected from an object, such as a printed substrate. Changing the amount of ink or other medium applied to a substrate changes the amount of color on the printed substrate, and hence the quality of the perceived image.

Each of the individual single images is produced with a specific color ink, referred to in the art as "primary colors" or "process colors". A multi-colored printed image is produced by combining a plurality of superimposed single color printed images onto a substrate. To create a multi-colored image, inks are applied at a predetermined pattern and thickness, or ink density. The ink patterns are generally not solid, but are composed of arrays of dots which appear as solid colors when viewed by the human eye at a distance. The images produced by such arrays of colored dots are called halftones. The fractional coverage of the dots of a halftone ink pattern combined with the solid ink density is referred to as the optical density of the ink pattern. For example, when ink dots are spaced so that half the area of an ink pattern is covered by ink and half is not, the coverage of the ink pattern is considered to be 50%.

The color quality of a multi-colored printed image is determined by the degree to which the colors of the image match the desired colors for the image, i.e. the colors of a reference image. Hence, the obtained quality of a multi-color image is determined by the density of each of the individual colored images of which the multi-colored image is composed. An inaccurate ink density setting for any of the colors may result in a multi-colored image of inferior color quality. An offset printing press includes an inking assembly for each color of ink used in the printing process. Each inking assembly includes an ink reservoir as well as a segmented blade disposed along the outer surface of an ink fountain roller. The amount of ink supplied to the roller train of the press and ultimately to a substrate, such as paper, is adjusted by changing the spacing between the edge of the blade segments and the outer surface of the ink fountain roller to change (either increase or decrease) the amount of ink printed onto the substrate in one or more ink zones (ink key zones). The position of each blade segment relative to the ink fountain roller is independently adjustable by movement of an ink control mechanism/device such as an adjusting screw, or ink key (ink control key), to thereby control the amount of ink fed to a corresponding longitudinal strip or ink zone of the substrate, wherein an "ink zone" (or "ink key zone") refers to an area of the substrate extending across a width of the substrate. The ink control mechanism includes any device that controls the amount of ink fed to a corresponding longitudinal strip or zone of the substrate. The ink control keys each control the amount of ink supplied to a respective ink zone on the substrate.

In the printing industry, color bars have been used for a long time to measure ink density. A color bar comprises a series of color patches of different colors in each ink zone, wherein each color patch comprises one or more color layers. To achieve a desired (i.e. target) ink density for printed information on a substrate, the printing press operator measures the ink density of the color patch or patches in one or more ink zones. The ink density of a color is determined by the settings of the ink supply for the ink of that color. A printing press operator adjusts the amount of ink applied to the substrate to get a desired color having a desired ink density. Opening an ink key increases the amount of ink along its zone and vice versa. If the ink density of the patch is too low, the operator opens the ink key to increase amount of ink flowing to the substrate in the corresponding ink zone. If the ink density of the patch is too high, the operator closes the ink key to decrease the amount of ink flowing to the substrate. Generally, it is assumed that the change in color density of the patches also represents a similar change in the color density of the printed image. However, this assumption is not always correct. To adjust for this discrepancy, the press operator should take the color bar patch density only as a guide, while final color adjustments are made by visually inspecting the printed information, and also by measuring the color ink density, or color values, of critical areas in the print. Where used herein, the term "color" is used in reference to black ink, as well as inks of primary process colors cyan, magenta and yellow.

At the start of a printing run, the ink key settings for the various color inks must be set to achieve the appropriate ink density levels for the individual color images in order to produce multicolor images with the desired colors. Additionally, adjustments to the ink key settings may be required to compensate for deviations in the printing process of colors during a printing run. Such deviations may be caused by alignment changes between various rollers in the printing system, the paper stock, web tension, room temperature and humidity, among other factors. Adjustments may also be required to compensate for printing process deviations that occur from one printing run to another. In the past, such ink density adjustments have been performed by human operators based merely on conclusions drawn from the visual inspection of printed images. However, such manual control methods tended to be slow, relatively inaccurate, and labor intensive. The visual inspection techniques used in connection with manual ink key presetting and color control are inaccurate, expensive, and time-consuming. Further, since the required image colors are often halftones of ink combined with other ink colors, such techniques also require a high level of operator expertise.

Methods other than visual inspection of the printed image are also known for monitoring color quality once the press is running. Methods have been developed to control ink supplies based on objective measurements of the printed images. To conduct the task of color density measurement, offline density measurement instruments are available. Quality control of color printing processes can be achieved by measuring the optical density of a test target image. Optical density of various points of the test target image can be measured by using a densitometer or scanning densitometer either offline or online of the web printing process. Typically, optical density measurements are performed by illuminating the test target image with a light source and measuring the intensity of the light reflected from the image. For example, a press operator takes a sample of printed substrate with the color bars and puts it in the instrument. A typical instrument has a density scanning head traveling across the width of the color bars. After scanning, the instrument displays density measurements on a computer screen. Upon examining the density values on display and also examining the printed sample, the operator makes necessary changes to the ink keys. This procedure is repeated until satisfactory print quality is achieved.

To automate this task, online density measurement instruments are known. While the press is running, it is common for a press operator to continually monitor the printed output and to make appropriate ink key adjustments in order to achieve appropriate quality control of the color of the printed image. For example, if the color in a zone is too weak, the operator adjusts the corresponding ink key to allow more ink flow to that zone. If the color is too strong, the corresponding ink key is adjusted to decrease the ink flow. During operation of the printing press, further color adjustments may be necessary to compensate for changing press conditions, or to account for the personal preferences of the customer.

Online instruments comprise a scanning assembly mounted on the printing press. The test target image that is measured is often in the form of a color bar comprised of individual color patches. The color bar typically extends the width of the substrate (see FIG. 7). Typically, color bars are scanned on the printing press at the patches, which include solid patches and halftone patches for each of the primary ink colors, as well as solid overprints. The color bar is often printed in the trim area of the substrate and may be utilized for registration as well as color monitoring purposes. Each solid patch has a target density that the color control system attempts to maintain. The inking level is increased or decreased to reach this target density.

Instruments that can measure density on the press and also automatically activate ink keys on the press to bring color density to a desired value are commonly known as Closed Loop Color Controls. A Closed Loop Color Control is primarily used to perform three tasks. The first task is to analyze the image from pre-press information to find the coverage of different colors in different ink zones and preset the ink fountain key openings to get the printed substrate close to the required colors. Ink key opening presets are just an approximation and may not be a perfect setting. The second task is to analyze the color information scanned from the substrate being printed on the press, compare it with the desired color values and make corrections to the ink key openings to achieve the desired color values. The third task is to continuously analyze the printed substrate and maintain color values throughout the job run length.

Different density measuring instruments vary in the way they scan color bars and calculate color patch density. Different scanning methods can be categorized into two groups. A first group uses a spectrophotometer mounted in the imaging assembly. A video camera and strobe are used to freeze the image of moving substrate and accurately locate color bars. The spectrophotometer is then aligned to a color patch and it is used to take a reading of the color patch. For positioning color patches in the longitudinal Y direction of the substrate, a cue mark and a photo sensor are used. For distinguishing color patches from print, a special shape of color patch is required for this instrument. A second group uses video cameras mounted in an imaging assembly. Typically, a color camera with a strobe is used to freeze the motion of the moving substrate and acquire an image. Most manufacturers use a three sensor camera, in which prisms are used to split red, green and blue channels. Analog signals from these three channels are fed to frame acquiring electronics to digitize and analyze image.

Most manufacturers use xenon strobes for illuminating the moving substrate for a short period of time. Xenon strobes work on the principle of high voltage discharge through a glass tube filled with xenon gas. It is well known that the light intensity from flash to flash with such a device is not consistent. This becomes a problem in color measurement since variation in flash intensity provides false readings. To overcome this problem, a system described in U.S. Pat. No. 6,058,201 uses a light output measurement device in front of the strobe and provides correction in color density calculations. Another problem with xenon strobes is that they work with higher voltage and drive electronics generate electrical noise and heat. These features make it more difficult to package a camera and xenon strobe in a single sealed imaging assembly. Another prior system described in U.S. Pat. No. 5,992,318 mounts the strobe away from the camera and transmits light through a light pipe.

To overcome these problems, it is desirable to use white light emitting diode (LED) light strobes with a single sensor color camera to measure color values on the color bar to accomplish closed loop color operation on the press. White LEDs provide a light source with very consistent light from flash to flash. Also, the LEDs operate at a very low voltage and current. This reduces heat generation in the imaging assembly and it also eliminates electrical noise typically associated with xenon light strobes.

All of the above mentioned methods use a color bar with a combination of solid and tint patches to measure the color across the width of the substrate. Unfortunately, measuring the color of a printed substrate using a color bar has several disadvantages. First, it is an indirect method of measuring color in the print, whereby it is assumed that the change in color density of a patch in the color bar represents the change in the color value of the printed substrate in the longitudinal zone aligned with the measured patch. However, this assumption is not always correct. Second, the color bar requires additional space on the substrate. Depending on job configuration, this space may not be available. Further, this additional substrate space is not part of the finished product, so it increases the cost of production. In addition, there are associated trimming costs for printed products for which a color bar is objectionable, thereby increasing the cost of the operation, as well as the costs associated with removing and disposing of trimmed color bar waste.

Alternatively, measuring the color of a printed substrate with a color bar does have its advantages. First, a color bar provides dedicated patches for each color that can be measured by the control as well as by the press operators using hand held color measuring instruments. Further, different types of patches (such as 25% tint, 50% tint, 75% tint, trap overprint) can be printed to check overall performance including pre-press settings, ink and water balance.

For different press configurations and job requirements, it may or may not be possible to have color bars. While a color bar may have some advantages, the job and press configuration may not allow having a color bar. In such a case, the operator has to adjust the press by visually inspecting the image or by measuring the color value within the print using a hand held densitometer, and the operator has to choose the places where he would like to measure the color value, and the densitometer readings may not be correct if colors are mixed in the area being inspected. Due to the obstacles associated with color bars, it is desirable to provide an option to eliminate the color bar and automate the image inspection to significantly improve the overall efficiency of the printing process.

Several attempts have been made to measure color values in an image directly from a printed substrate. A number of past efforts have been explored through which color information on a print can be acquired and analyzed. For example, U.S. Pat. No. 5,967,050 teaches a method which takes images of a printed substrate and aligns the obtained image with a reference image from available pre-press information and calculates color error on pixel-by-pixel basis. The operation requires a lot of computation power making it very expensive and slow. These requirements make it practically impossible to implement Closed Loop Color Control without a color bar.

Another method of getting color information in each ink zone may involve taking multiple images in an ink zone and aligning and analyzing the images with the corresponding locations on the image information from the pre-press information on a pixel-by-pixel basis. This would also require a lot of computation power since images in the same ink zone have to be captured, aligned to the pre-press image, processed and analyzed.

Yet another method of getting the color information in each ink zone is by positioning a camera in an ink zone, illuminating the region under camera with a constant illumination light source (i.e. non-strobing) and keeping the camera shutter open for a certain time. In order to get a correct color reading, the shutter opening and closing should be synchronized with the substrate movement such that the number of press repeats passing under the camera are exact multiples, otherwise color information for the partial press repeat scanned is also added to the reading. Since color values read from the camera are dependent on the amount of light received by the sensor in a specific time, this method becomes speed sensitive. Any variation due to change in speed has to be compensated mathematically or by changing the light illumination intensity. Both solutions suffer from inherent inaccuracies and errors making it practically very difficult to implement this solution. This system is further disadvantageous because the light reflected from non-printed areas also gets integrated into the frame. If there is heavy coverage of various colors, the resulting integrated frame shows a very dark and gray looking frame. If there is a very small area being printed on the ink zone, the image of printed area gets diluted by the image of the non-printed area of the substrate to a point where the final frame may not be able to provide enough resolution information about the printed color.

A further method of obtaining color information in each ink zone is by keeping the camera shutter open for a time greater than the time for one press repeat to pass under the camera and using a strobe light to illuminate several sections of the ink zone and using the charge-coupled device (CCD) in the camera to accumulate the reflected color value for the whole repeat length. This method relies on the fact that the frame produced by such integration (multiple exposures) is a representative of total color in the ink zone area. The disadvantage of this system is that the light reflected from non-printed areas also gets integrated in the frame. If there is heavy coverage of various colors, the resulting integrated frame shows a very dark and gray looking frame. If there is a very small area being printed on the ink zone, the image of printed area gets diluted by the image of the non-printed area of the substrate to a point where the integrated frame may not be able to provide enough resolution information about the printed color.

The present invention provides an improved approach to measure color values on a printed substrate, where gray balance is monitored as well as overall color saturation in a printed image. The system of the present invention is capable of operation in either "Color Bar with Solid Ink Density" or "Gray Spot with Gray Balance" modes, where an operator has the choice to implement Closed Loop Color Control with or without a color bar printed on the substrate as per the methods of commonly owned U.S. Pat. Nos. 7,187,472 and 7,477,420, combined with the additional Gray Spot with Gray Balance feature of the present invention. More particularly, a Universal Closed Loop Color Control system is provided that allows real-time, four process color control and monitoring on a printing press using obscure gray dots printed in the page margins rather than color bars. The gray dots are unobtrusive, do not attract the eye and need not be trimmed, saving cost in labor and disposal. The system is universal by allowing the operator to choose and easily switch between the inventive gray spot (i.e. gray reference marker) analysis and conventional color bar analysis. The inventive system provides an alternative in the art for an efficient and inexpensive method for closed loop color control by allowing for measurement and determination of color density variations, as well as for controlling the plurality of ink control mechanisms, or ink keys, on a printing press for on-the-run color correction whether a color bar is present or not.

The process of the present invention is compatible with the operation of a printing press, such as sheet fed and web presses, and offset printing, Gravure printing, Flexo printing and generally any other printing processes. The system can communicate with the latest press controls as well as older presses for scanning, measuring and correcting color on the run.

SUMMARY OF THE INVENTION

The invention provides a process for measuring and controlling a color value of one or more colored image portions which are printed on a planar substrate, the process comprising:

(a) providing one or more colored image portions which are printed on a planar substrate, each colored image portion comprising one or more colors produced by one or more colored inks;

(b) providing one or more pairs of reference markers printed on the planar substrate in one or more ink zones and positioned adjacent to said one or more colored image portions, wherein each pair of reference markers comprises a primary reference marker and a secondary reference marker; wherein the primary reference marker comprises black ink and the secondary reference marker comprises one or more of cyan, magenta and yellow ink components; wherein each of said primary reference marker and said secondary reference marker has an ink density value, wherein said black, cyan, magenta and yellow inks each have an individual ink density value when present;

(c) providing at least one imaging assembly, wherein the imaging assembly is capable of capturing digital representations of each of said reference markers;

(d) controlling the positioning and linear movement of said imaging assembly across the planar substrate;

(e) selecting and acquiring a digital image with the imaging assembly of the primary reference marker and the secondary reference marker within one or more pairs of reference markers in at least one ink zone;

(f) analyzing the digital image of the primary reference marker and the secondary reference marker of each imaged reference marker pair to determine the ink density value for each reference marker within each imaged reference marker pair and the individual ink density values for each ink component of each reference marker;

(g) comparing the ink density value of the primary reference marker and the ink density value of the secondary reference marker of each imaged reference marker pair and determining any difference between the ink density value of said primary reference marker and the ink density value of said secondary reference marker of said imaged reference marker pair, and optionally storing said difference in a memory;

(h) optionally comparing the ink density value of the primary reference marker and/or the ink density value of the secondary reference marker of each imaged reference marker pair with a target ink density value for at least a portion of the one or more colored image portions on the substrate in at least one ink zone, and determining any difference between the ink density value of the primary reference marker and/or the ink density value of the secondary reference marker of each imaged reference marker pair and the target ink density value for the at least a portion of the one or more colored image portions on the substrate in at least one ink zone, and optionally storing said difference in a memory;

(i) optionally adjusting the ink quantity of black and/or colored ink being printed onto the substrate such that the ink density value of the primary reference marker in a reference marker pair is equivalent to the ink density value of the secondary reference marker in said reference marker pair, and/or such that the ink density value of the primary reference marker and/or the ink density value of the secondary reference marker in a reference marker pair is equivalent to the ink density value of a manually specified ink density value, and/or such that the ink density value of the primary reference marker and/or the ink density value of the secondary reference marker in a reference marker pair is equivalent to the target ink density value for at least a portion of the one or more colored image portions on the substrate in at least one ink zone; and (j) optionally repeating steps (d)-(i) for at least one of any additional ink zones.

The invention also provides a process for controlling an amount of ink fed from a plurality of inking units in a multicolored printing press onto a planar substrate fed through the press, which substrate is in a web or sheet form, said substrate having one or more colored image portions printed thereon from the inking units, which image portions are printed across a width of the substrate in one or more ink zones, each colored image portion comprising one or more colors, wherein each color has an individual color value, the system being capable of functioning in the presence of or absence of a color bar, the process comprising:

(a) providing one or more colored image portions which are printed on a planar substrate, each colored image portion comprising one or more colors produced by one or more colored inks;

(b) determining whether a color bar is printed on the planar substrate, which color bar comprises a plurality of color patches, wherein at least one color patch is printed in each ink zone, wherein each color patch comprises one or more color layers; and determining whether one or more pairs of reference markers are printed on the planar substrate adjacent to said one or more colored image portions and in one or more ink zones, wherein each pair of reference markers comprises a primary reference marker and a secondary reference marker; wherein the primary reference marker comprises black ink and the secondary reference marker comprises one or more of cyan, magenta and yellow ink components; wherein each of said primary reference marker and said secondary reference marker has an ink density value, wherein said black, cyan, magenta and yellow inks each have an individual ink density value when present, and wherein the ink density value of the secondary reference marker optionally equals the combined individual ink density values of the cyan, magenta and yellow inks;

(c) if one or more pairs of reference markers are present, conducting step (I), and if a color bar is present, but no reference markers are present, conducting step (II):

(I) (i) providing at least one imaging assembly, wherein the imaging assembly is capable of capturing digital representations of each of said reference markers;

(ii) controlling the positioning and linear movement of said imaging assembly across the planar substrate;

(iii) selecting and acquiring a digital image with the imaging assembly of the primary reference marker and the secondary reference marker within one or more pairs of reference markers in at least one ink zone;

(iv) analyzing the digital image of the primary reference marker and the secondary reference marker of each imaged reference marker pair to determine the ink density value for each reference marker within each imaged reference marker pair and the individual ink density values for to each ink component of each reference marker;

(v) comparing the ink density value of the primary reference marker and the ink density value of the secondary reference marker of each imaged reference marker pair and determining any difference between the ink density value of said primary reference marker and the ink density value of said secondary reference marker of said imaged reference marker pair, and optionally storing said difference in a memory;

(vi) optionally comparing the ink density value of the primary reference marker and/or the ink density value of the secondary reference marker of each imaged reference marker pair with a target ink density value for at least a portion of the one or more colored image portions on the substrate in at least one ink zone, and determining any difference between the ink density value of the primary reference marker and/or the ink density value of the secondary reference marker of each imaged reference marker pair and the target ink density value for the at least a portion of the one or more colored image portions on the substrate in at least one ink zone, and optionally storing said difference in a memory;

(vii) optionally adjusting the ink quantity of black and/or colored ink being printed onto the substrate such that the ink density value of the primary reference marker in a reference marker pair is equivalent to the ink density value of the secondary reference marker in said reference marker pair, and/or such that the ink density value of the primary reference marker and/or the ink density value of the secondary reference marker in a reference marker pair is equivalent to the ink density value of a manually specified ink density value, and/or such that the ink density value of the primary reference marker and/or the ink density value of the secondary reference marker in a reference marker pair is equivalent to the target ink density value for at least a portion of the one or more colored image portions on the substrate in at least one ink zone; and (viii) optionally repeating steps (ii)-(vii) for at least one of any additional ink zones;

(II) (i) providing at least one imaging assembly, wherein the imaging assembly is capable of capturing digital representations of each of said reference markers;

(ii) controlling the positioning and linear movement of said imaging assembly across the planar substrate;

(iii) selecting and acquiring a digital image with the imaging assembly of one or more color patches in a first ink zone;

(iv) analyzing the acquired digital image of the one or more color patches to determine an actual ink density value for each color patch;

(v) comparing the actual ink density values of each color patch to a target ink density value for each color patch and determining any difference between the actual ink density value and the target ink density value for each color patch, and optionally storing said difference in a memory; and (vi) optionally adjusting the ink quantity being printed on the substrate such that the actual ink density value of the one or more color patches in the first ink zone is equivalent to the target ink density value for each corresponding color patch; and (vii) optionally repeating steps (ii)-(vi) for at least one additional color patch in at least one of any additional ink zones.

The method of the invention is a universal closed loop color control system that may be run in a color bar mode and scan simple rectangular color patches corresponding to each ink zone in the print units, or can run in gray spot mode and maintain gray balance if the job has critical half tone images, or if the color bar is obtrusive on the job. This choice of mode of operation is made by the operator. This new system works in concert with all modes of operation described in commonly owned U.S. Pat. No. 7,187,472 (color bar process, i.e. "CCC") and U.S. Pat. No. 7,477,420 (barless process, i.e. without a color bar, i.e. "BCC"), and the disclosures and computer programs of these two patents are incorporated herein by reference to the extent not inconsistent herewith, giving the operator the choice of color control at the time of running the job. In the present inventive process, each time a colored target (color patch or reference marker (grey or multicolor) passes under the imaging assembly, a custom LED strobe as described in commonly owned U.S. Pat. Nos. 7,187,472 and 7,477,420 illuminates the patch area/reference marker area for microseconds and an image is acquired with a color camera. The central processing unit (CPU)/processor recognizes the colored targets and accurately calculates their color values. Based on these values, the CPU sends commands to remote processors for adjusting individual ink keys.

Equipped with a fountain presetting feature, the system of the present invention can significantly reduce startup waste and provide consistent quality throughout a run. The closed loop color control process of the invention is especially designed for high speeds web presses, and includes a "Scan Accelerator Mode" that significantly reduces the total scan time across the substrate. The system is also capable of choosing optimum ink stroke settings in addition to presetting the ink keys, allowing the press operator to override recommended ink stroke settings. The system is also capable of adjusting ink stroke in automatic mode to keep ink keys and ink stroke balanced.

In the preferred embodiments of the invention, the inventive system preferably, but not necessarily, provides one or more of the following features and benefits:

For the color bar mode, the patches may be as small as 0.06"×0.14" (1.5 mm×3.5 mm) or any other standard size, with only 0.010" white space around color patches. In color bar mode, the system tracks solid ink density, dot gain, print contrast, and grayness, and supports PMS colors. In gray spot mode, the reference markers may be round spots as small as 0.06" diameter. The unique image pattern recognition of the invention is very tolerant to misregistration, and has excellent tolerance to blanket wash print disturbance.

The inventive system may be used with 10 print units, with 2 web (4 surface) configuration and up to 72" wide web width. The system includes auto tracking for immunity to web tension changes during splice cycle or lateral weave +/−0.5" (12 mm). The system also utilizes existing motorized ink keys, minimizing installation cost and down time, and a small format camera stand is incorporated for easy incorporation into existing press configuration.

The system uses CIP3 file analysis for image preview and fountain presetting, utilizes a paper library that supports both SWOP and custom paper types, and utilizes an integrated spot densitometer with programmable regions of interest. The system also allows operators to verify print live on the web using Universal Closed Loop Color Control (UCC) imaging, allows real time color image display during scan cycle, and presents statistical results that display current measurements compared with pre-programmed standards. Other features include statistical quality reporting, an out of range statistical quality alarm, and standard stroke and water control.

A virtually unlimited number of jobs can be stored, using job files to store ink key position, ink stroke and water settings, plus target color for each ink key on every ink fountain. The user interface is easy to learn, has online context-sensitive help, flat panel touch screen operation, and a practically maintenance free imaging assembly with a 100,000+ hour average LED strobe life. The majority of system components are commercially available from various sources, with optional multiple operator consoles are available for remote operations.

DETAILED DESCRIPTION OF THE INVENTION

The invention provides a system and processes for measuring and controlling the color values of one or more colored images or colored image portions during operation of a printing press, such as sheet fed and web presses, and offset printing, Gravure printing, Flexo printing and generally any other printing processes. The images being printed comprise one or more colors and are printed on a moving, planar substrate in one or more ink zones that extend across a width of the substrate. Using the equipment of either of commonly owned U.S. Pat. Nos. 7,187,472 or 7,477,420, color quality of the printed images are monitored and controlled by selecting and acquiring images of one or more pairs of reference markers on a moving or stationary substrate, determining a relationship between the reference markers within each pair, and automatically making any necessary ink quantity adjustments to equilibrate the ink density values of each reference marker within each pair.

It should be understood that when the term "color" is used herein, the term includes black as a color as well as cyan, magenta or yellow. It should also be understood that when the term "ink" is used herein, the term is intended to include toners, pigments, dyes and other colored substances and compositions commonly used to print text and images in the printing industry.

In a typical rotary printing process, printing cylinders having printing plates attached thereto are utilized. Conventionally, a positive or negative image is put onto a printing plate using standard photomechanical, photochemical or engraving processes. Ink is then applied to the plate's image area and transferred to the substrate. A single printing plate is generally used for each color used in forming the image. In a typical printing operation, printed images are formed from a combination of overlapping color layers of the process colors cyan, magenta, yellow, which are known in the art of printing as "primary colors", and black. Accordingly, at least four printing plates are typically used, one for each of those colors. Non-process colors may also be added to the color image by the use of additional plates.

Figure 10:
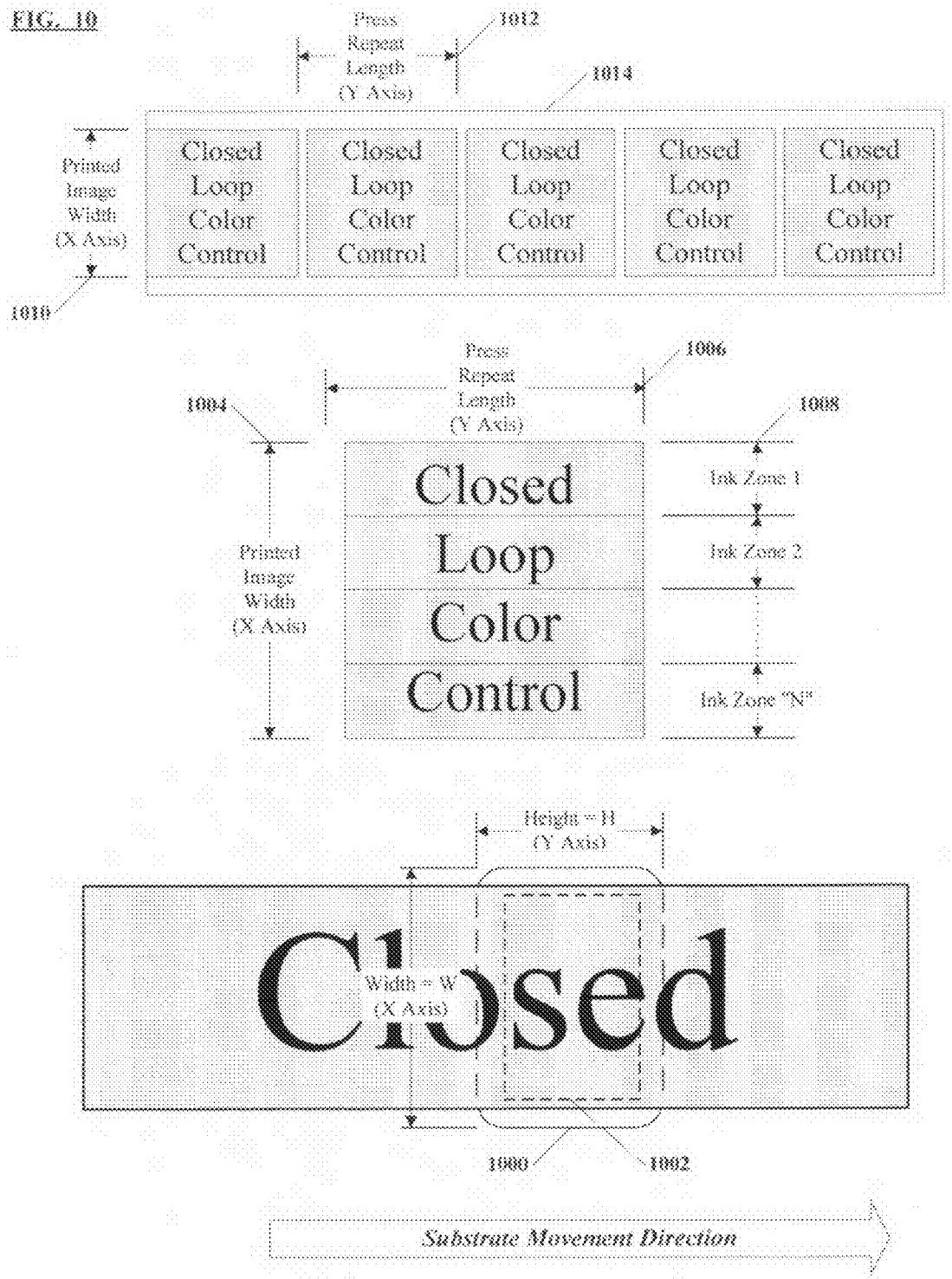
FIG. 10 illustrates the typical nature and layout of print and ink zones on the substrate.

As is well known in the art, when using a printing press, an image is repeatedly printed on a substrate and the print repeat length is equal to the circumference of the printing cylinder. In a typical printing press, an ink fountain provides the ink for the printing operation. The ink fountain may have several ink keys across the width of the fountain. Each ink key can be individually opened or closed via an ink control mechanism to allow more or less ink onto the corresponding ink zone (conventionally longitudinal) on the substrate. FIG. 10 offers an illustration of a substrate divided into multiple ink zones. Ink from the ink fountain may travel down an ink train through distributor rollers, and any change in the setting of an ink key affects the whole longitudinal path aligned with the ink zone. A typical printing press also has oscillator rollers. In addition to rotational motion, these oscillator rollers also have axial motion moving back and forth. The axial motion spreads ink along the ink zone to the adjacent ink zones.

According to the process of the invention, during the running of the press, the color values of reference markers are monitored through scanning the substrate surface with the imaging assembly, preferably continuously, to maintain the known difference between the ink density of a primary reference marker and the ink density of a secondary reference marker of one or more pairs of reference markers. Most preferably the ink densities of the primary and secondary reference markers are equal, and thus there is no difference between their ink densities, and that equilibrium is preferably maintained. The overall ink density of one or both of said reference markers is also preferably compared, preferably continuously, to a target ink density value for at least a portion of the colored image/one or more colored image portion(s) on the substrate in order to maintain an even ink density across the substrate, wherein the target ink density value for each individual color across the substrate, e.g. each individual color in each ink zone, and the ink density of one or both of the primary and secondary reference markers, are compared and preferably maintained at equilibrium. These target ink density values for the colored image/colored image portion(s) on the substrate may be obtained from provided pre-press information or may be identified via the methods described in commonly owned U.S. Pat. Nos. 7,187,472 and 7,477,420. During scanning of the printed substrate, images are taken of the substrate at the reference markers and the images are analyzed to determine updated ink density values for each color present, preferably comparing the reference markers to each other as well as to the target ink density values for the colored image/colored image portion(s) on the substrate.

More specifically, in gray spot mode, the system computer/processor (CPU) will determine the difference, if any, between the primary and secondary reference markers, which will correspond to the balance of the colors for each color as present in one or more ink zones. If there is a difference, i.e. if the ink density of the two reference markers is not equivalent, then an ink quantity adjustment will automatically be made on the substrate in the corresponding ink zone to bring the ink densities of the primary reference marker and the secondary reference marker into equilibrium. This will maintain the ink density values at the desired level as provided by pre-press information, as manually specified/set by the operator, or as otherwise generated. This process may be repeated continuously during the entire printing operation as may be desired, and these steps of analyzing color balance and making any necessary adjustments to the color values for each color in each ink zone are preferably continuously performed on the press for the complete job run length. Accordingly, the system of the invention monitors both gray balance and overall ink density of the ink being printed on the substrate, such that the colors being printed are both balanced and even across the page.

The technique used to do this is the same as used in the CCC device described in commonly owned U.S. Pat. No. 7,187,472. It should be understood that a press operator may also override any color values provided by pre-press information, as manually set by the operator, or otherwise generated, modify the colors being printed on the substrate, and then maintain the modified colors via the reference markers. If the colors are so modified, the substrate is then scanned with a scanner, e.g. the imaging assembly or other scanner, to determine modified color values, which are then monitored in the same manner. It should be further understood that ink densities (color values) may be affected by the characteristics of the substrate being printed on, e.g. matte or glossy paper, and this must be further taken into consideration in determining the ink densities. Typically, these substrate specific considerations will be taken into consideration by system software simply by registering the substrate type being used. In the preferred embodiment of the invention, an optical scatter computation and correction is also conducted for both gray spot and color bar readings.

In a preferred embodiment of the invention, the imaging assembly will also recognize and adjust for any physical movement of the substrate during the printing operation. This may be done on a regular basis to ascertain the alignment between the imaging assembly position and printed area corresponding to the ink zones. This is required because the path of the paper through the press is known to vary due to both press related and outside influence. This alignment step may also be performed after specific events on the press that may disturb the position of the substrate circumferentially or laterally. Some of the examples of such events are substrate roll splicing and blanket washing.

As mentioned herein, a preferred apparatus for use in the present invention is described in commonly owned U.S. Pat. No. 7,187,472. Described more specifically, the system of the present invention, Universal Closed Loop Color Control, preferably comprises one imaging assembly per surface scanned, each preferred imaging assembly (see FIG. 6A and FIG. 8A (810)), preferably comprising the following:

1. A commercially available color camera, FIG. 8A, 806 (e.g. Sony DFW-VL500). The camera preferably uses an interface such as IEEE1394, USB2, Ethernet, etc., for setup as well as transferring the image into a computer. No special frame grabber or other hardware is required to transfer the image from camera. The camera preferably has built in motorized zoom, motorized iris and motorized focus control that can be easily controlled using the IEEE1394 interface from the computer. Each camera has a unique serial number stored in its memory and is individually addressable. The exposure and other image processing are manually controllable to ensure precisely repeatable images from frame to frame. Finally, the camera may be triggered at a precise time, with accuracy to microseconds, to ensure capturing the desired color sample.
2. An illumination source, FIG. 5, FIGS. 8A-8C, 812: To overcome problems of xenon strobes, white LED light strobes are preferably used to freeze the image of a moving substrate, i.e. a substrate in motion on a printing press. Since white LEDs are available with different color temperature specifications, a grade suitable for the optimum setting of the camera is selected and white balance is achieved by manually setting camera parameters. Very bright LEDs are available and preferred. The light assembly can have one point light source, FIG. 8, 820, or an array of multiple light sources, FIG. 8, 840, to provide the required strobe light brightness. In general, any illumination source may be used, but a white LED light strobe as described herein is the most preferred illumination source.

Camera trigger pulse width and its timing relationship to the strobe are very important. The strobe's electronics will condition the input trigger signal for appropriate camera triggering. Power for the imaging assembly is preferably provided from a commercially available 24 VDC switching power supply. A trigger input signal is generated by a counter board mounted in the computer, FIG. 1, 100, driven from a quadrature encoder, FIG. 1, 126, coupled to one printing cylinder on the press. This is used to synchronize the camera to the printed image in order to obtain the desired black/color samples.

Figure 6A:
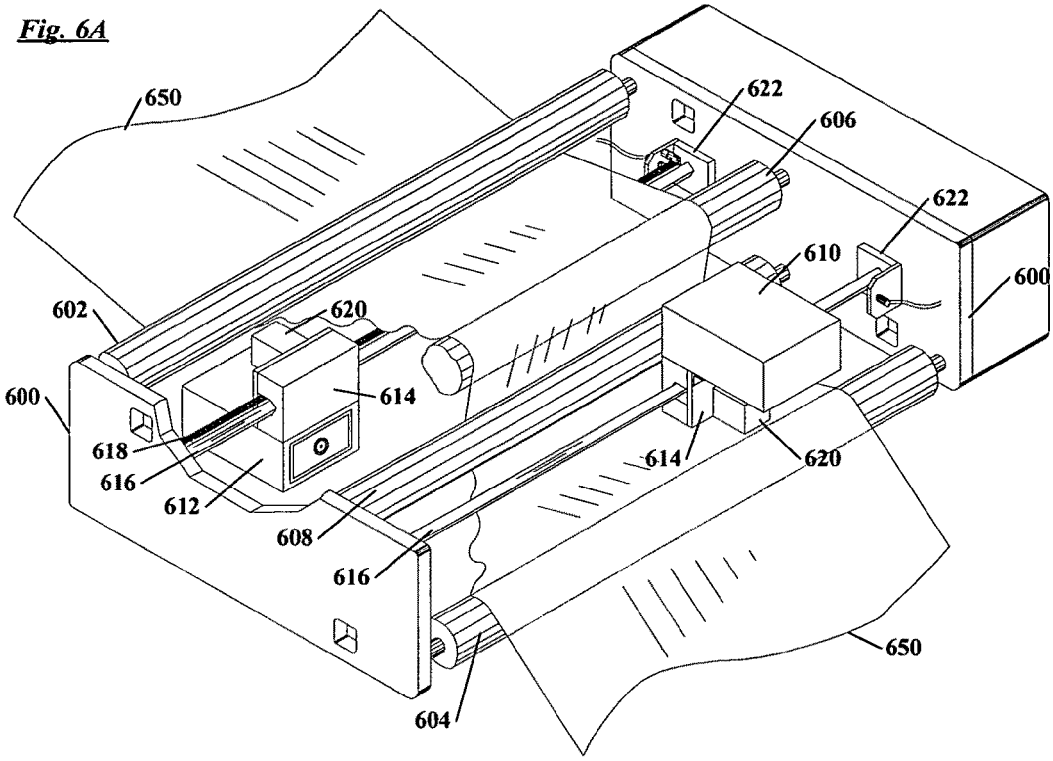
FIG. 6A and FIG. 6B are perspective and side views of equipment for scanning a printed substrate by mounted strobes and cameras.

Each imaging assembly further preferably comprises a linear drive for moving the illumination source and digital camera together across the substrate. This linear drive allows the imaging assembly to be moved in a direction perpendicular to the direction of travel of a moving substrate, and allows the imaging assembly to move in two orthogonal directions relative to a surface of a stationary substrate. In the preferred embodiment, each imaging assembly is preferably mounted on a carrier bracket moving on a track and guide system, FIG. 6A, 622. A linear drive in the form of a motor with an embedded microcontroller, FIG. 6A, 620, is preferably installed on the carrier bracket. A timing pulley is preferably installed on the shaft of the motor. A stationary timing belt is preferably installed with two ends anchored to the brackets near the opposite ends of travel of the imaging assembly. A proximity sensor preferably is provided at one or both ends of the track and allows the system to sense the end of travel for the imaging assembly. The motor preferably communicates with the computer through an RS-485 network, FIG. 1, 140. All devices on the RS-485 network are preferably individually addressable. Each imaging assembly motor is programmed with a different network address and performs independently of the other motors and assemblies.

Figure 1:
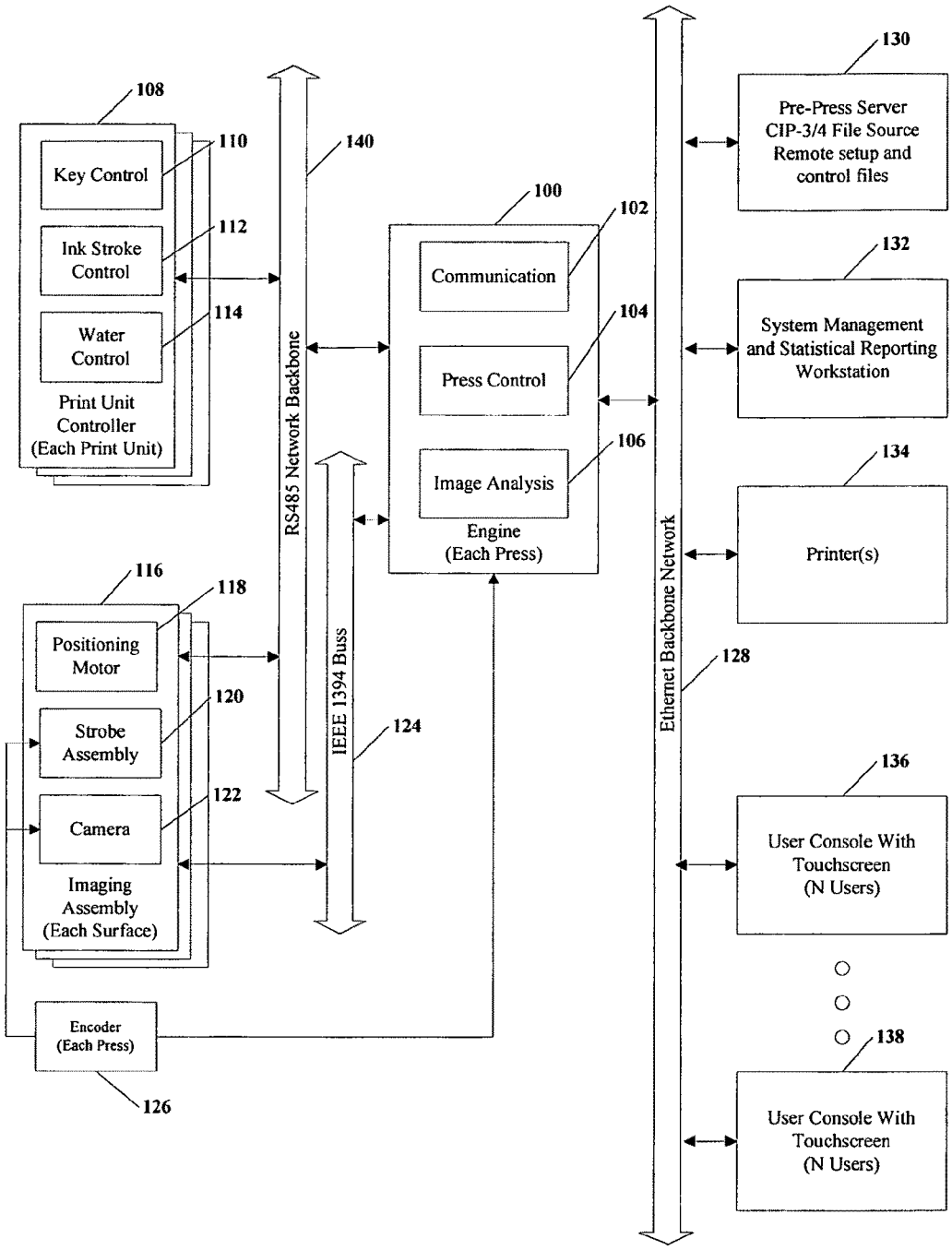
FIG. 1 is a flowchart showing a system overview of the inventive color control system.

The UCC engine is a computer, FIG. 1, 100, that preferably comprises the following items:

1. A Pentium® processor based motherboard. It also incorporates serial ports, parallel ports, a floppy disk controller, hard drive controller, USB ports and expansion slots.
2. A power supply for supplying appropriate DC power as required.
3. A hard disk drive for permanently storing the operating system, application programs and data.
4. A CD-ROM drive to accept portable and/or transient programs and data.
5. A floppy disk drive to accept portable and/or transient programs and data.
6. A video controller board and display monitor to provide the user interface.
7. An IEEE1394 (Firewire) interface card with multiple ports to communicate with cameras.
8. An Ethernet networking interface card to communicate with consoles and other devices on the network.
9. A USB port to interface with other devices.
10. An Input/Output board to interface with the printing press and other devices.
11. A counter board to take quadrature and index signals from the encoder and provide trigger signals to the appropriate imaging assembly.

An external RS-232 to RS-485 converter is preferably provided for communication with the imaging assembly positioning motors and print unit controllers in the system. While RS-232 is the standard for personal computers, the RS-485 standard provides additional margins against communications errors and increased signaling distance in the industrial environment. Single or multiple user consoles, FIG. 1, 136, 138, with touch screens preferably communicate with the engine using the Ethernet backbone, FIG. 1, 128.

The engine also communicates with one or more print unit controllers (PUCs) (see FIG. 3) to set and read ink key positions, water settings, ink stroke settings and other print unit functions. In addition to this, the print unit controller reports any faults and exceptions information to the engine. The engine can communicate with PUCs manufactured by any provider with a suitable protocol.

The engine can also communicate with a pre-press system, FIG. 1, 130, to get job settings, printed image data and ink key presetting data. The standard format in the industry is called the CIP3 file format, but other file formats can also be used to communicate job specific details from the pre-press software to the engine.

A console preferably comprises a computer with an Ethernet network adapter and a touch screen. All common operations for the system are performed using the touch screen of the console, though some maintenance operations may need to be performed directly on the engine using its local keyboard, mouse and video screen. The console application program can also run on the same hardware as the engine. In such a case, an additional separate computer will not be required for the console.

An encoder is installed on the printing press coupled to the printing cylinder. The encoder has three channels—channel A, channel B and channel Z. Channels A and B are in a quadrature relationship with each other. Typical channel resolution is 2500 pulses per revolution of the encoder shaft yielding 10,000 pulses per revolution of encoder shaft. Channel Z provides one index pulse per revolution of the encoder shaft. All three channel signals are connected to the counter board in the engine. The function of the counter board is to reliably count each encoder pulse and provide accurate print cylinder position information. The engine can set at least one count value into the counter board per printed surface. When the encoder count matches this value, the counter board activates an output trigger pulse for the corresponding surface, initiating image acquisition from the camera and illumination source, e.g. strobe. Thus, the image location may correspond to anywhere on the printed substrate and the engine will still be able to synchronize the imaging assembly.

Printing press interface signals are read and set using the Input/Output board. Typical signals read from the press are press printing, blanket wash, and press inhibit. These are used to determine when accurate imaging may commence. Outputs from the system are provided to reset the imaging assemblies, and produce quality alarms and scan error alerts. Based on press installation requirements, the Input/Output board may be substituted with USB based or other I/O devices performing the same function.

The invention further comprises a display screen for presenting a visual representation of information, including the one or more colored image portions, the one or more pairs of reference markers, the ink density values of the primary and secondary reference markers, the individual ink density values of the cyan, magenta, yellow and/or black inks, ink density value comparison data, digital images of the colored image portions or digital images of the reference markers, or combinations thereof. This display screen preferably comprises said console.

Figure 7:
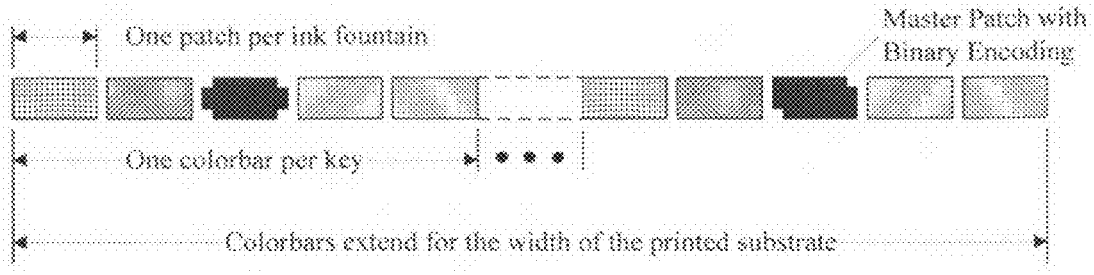
FIG. 7 is a schematic representation of color bars and color patches, which are printed on a substrate.
Figure 12A:
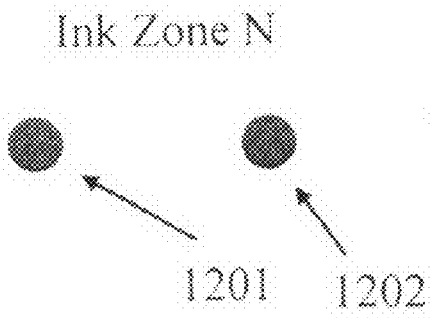
FIG. 12A is a schematic representation of a pair of reference markers in relation to each other.
Figure 12B:
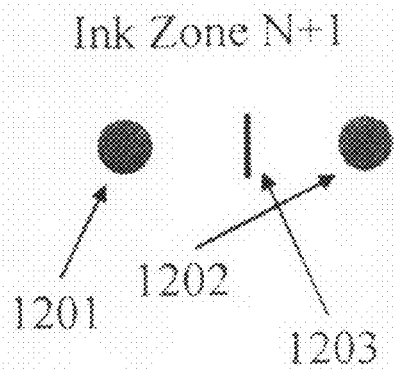
FIG. 12B is a schematic representation of a position marker in between primary and secondary reference markers.
Figure 13:
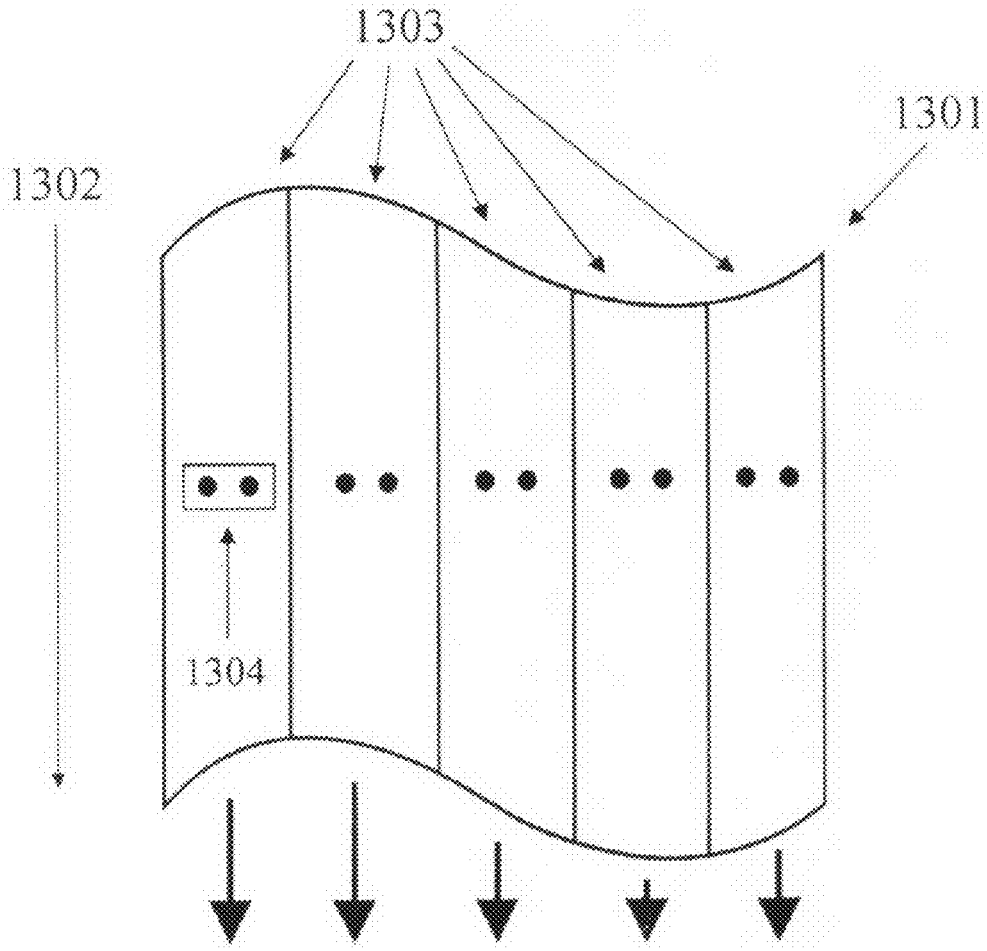
FIG. 13 is a schematic representation of reference markers in relation to a substrate, having one pair of reference markers within each ink zone.

The UCC apparatus is able to function both in the presence of a color bar and in the absence of a color bar, using gray spot analysis when the color bar is absent. Illustrated in FIG. 12A is a schematic representation of a pair of reference markers in relation to each other. Pairs of gray reference markers are printed on each image produced by the printing press in order to determine a balance of the colors being printed from each print unit. The associated artwork for the reference markers is provided by the present UCC program. A reference marker pair/pattern may be printed in one or more ink zones, and if multiple ink zones are present may be printed in all or only some of the ink zones. Preferably, but not necessarily, a reference marker pair/pattern repeats for each ink key in the print fountain (ink zone on the substrate). When a plurality of reference marker pairs are present, they are scanned by the imaging assembly either sequentially or simultaneously, but typically sequentially along the present ink zones. The resulting ink density values are used to determine the correct ink key settings as described herein, where the reference markers are compared to a target (desired) ink density, which target ink density is either provided by pre-press information, manually set by the operator, or otherwise determined, to set overall ink saturation levels for the entire substrate across one or more ink zones, as well as comparing the ink density of the reference markers to each other to maintain ink density equilibrium and, accordingly, neutral tone. Illustrated in FIG. 12B is a schematic representation of a position marker in between primary and secondary reference markers. Illustrated in FIG. 13 is a schematic representation of reference markers in relation to a substrate, having one pair of reference markers within each ink zone. Illustrated in FIG. 7 is a schematic representation of a color bar, wherein a single color bar has a plurality of color patches. The associated artwork for the color patches/color bars is provided by the present UCC program. In color bar mode, color bars are printed on each image produced by the printing press in order to obtain representative samples of target color from each print unit. A color bar pattern typically, but not necessarily, repeats for each ink key in the print fountain. These patches are scanned by the imaging assembly and the resulting color values are used to determine the correct ink key settings.

Using one of the consoles of the invention, a press operator sets up following job specific details:

1. Color printed by each fountain in a system.
2. Ink Fountain to surface relation.
3. Color of a color bar master patch (in a CCC process, as per commonly owned U.S. Pat. No. 7,187,472).
4. If the job uses color bar or the job would run in gray spot mode.
5. Location of color bar or reference markers from leading edge of the print.
6. Starting and ending ink zone location for imaging assembly scanning.
7. Location for multiple regions of interest (X and Y coordinates) for each surface in the system.
8. If the job uses a color bar, the configuration specifying following details for each patch in ink zone in the system:
   (a) Color of each patch (Cyan/Magenta/Yellow/Black/Special color)
   (b) Type of patch (Solid/50% density/75% density/clear/trap/etc.)
9. The target color values (target density; known from pre-press information) for each color to be printed on the substrate (Note, the operator may also override the color neutrality and add a tint to the image by changing target densities).
10. Type of substrate (paper) to be printed upon (coated/newsprint/etc.)
11. CIP3 or other file type available from pre-press software to provide coverage data for each color being printed on each surface of the substrate. This information is used to determine initial ink key preset and ink stroke preset. This information may also be obtained by separately scanning the substrate to determine target color values. This determines the initial starting point, or preset, for the ink keys, and is done regardless of how ink density data is collected during a printing run.

Job files are preferably edited locally on the user console and therefore can be created or changed independently of the job running on the engine. As used herein, the term "job file" is used to describe a memory. After editing, all job files are preferably saved on a central file server memory which may be physically co-located with the engine or console, or which may exist independently on the network. When the operator is ready to run a job, he selects from the list of stored jobs and touches the RUN button on touch screen. Preset values of ink keys, ink stroke and water are communicated to the print unit controllers which in turn set up the printing press. The engine also preferably polls each PUC periodically to confirm that communication link is alive and also to read back positions of controlled ink keys, ink stroke and water settings, PUC status and alerts. The communication protocol between the engine and PUC depends on the specific requirements of different makes of PUCs.

Figure 11:
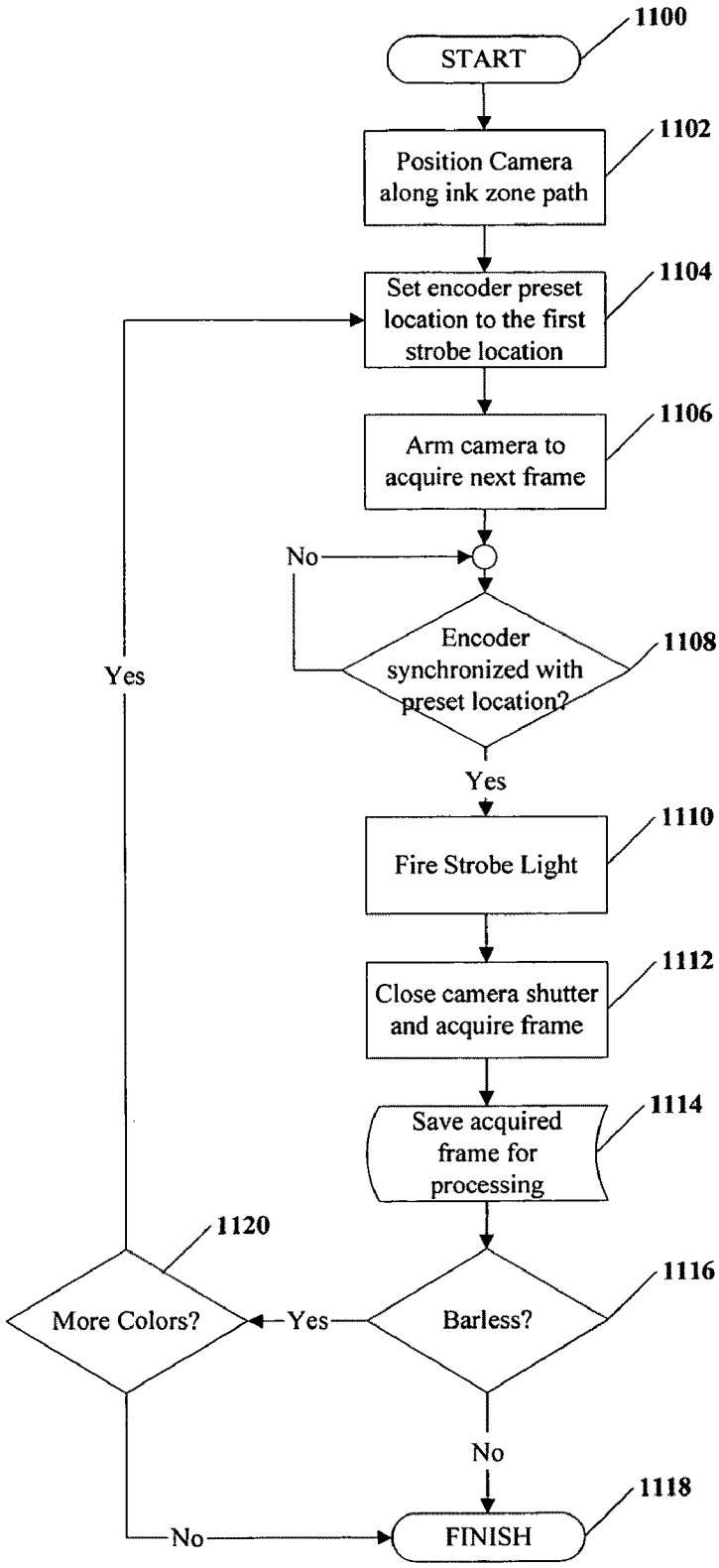
FIG. 11 is a flowchart illustrating the image acquisition process for getting color information for each ink zone according to the invention.

The operator can place one or multiple surfaces in AUTO mode. There are three different startup options for the AUTO mode: Ideal, Current and Last Used. "Ideal mode" brings all ink color values to those defined in the job file. "Current mode" reads the ink color values presently being printed and maintains these values or holds the color wherever the operator has manually set it. "Last mode" simply resumes with the previously used settings, assigning the color values which were used when this job was running last in AUTO mode. Preferably, the engine automatically saves all job settings and ink color values. When the operator starts printing on the press, the UCC apparatus gets a press printing signal from press. After a user defined delay (set by changing parameters) which allows the printed image to stabilize, the UCC engine sends commands to each imaging assembly motor to position the imaging assembly at a specific location. UCC also polls these motors to confirm that the required move is accomplished. The corresponding strobe board processes the trigger signal and image acquisition is initiated through the camera driver software. The acquired image is preferably stored in the random access memory (RAM) of the engine. Further processing of the acquired image, see FIG. 11, is performed based on the "color bar mode", see FIG. 2, or "gray spot mode" of job operation.

In the color bar mode, the UCC apparatus loads a count corresponding to the color bar location into the counter board and commands the counter board to start trigger pulses for image acquisition. Image analysis is performed to identify the color bar in the acquired image. If a color bar is not found in the acquired image, the engine changes the count in the counter board to advance or retard the area of the printed image visible to the imaging assembly. The search distance along the Y axis of the substrate is programmable with engine parameters. When a valid color bar is found in an acquired image, its location is stored for use. Next, a master color patch is preferably identified in the color bar and its location is saved. A master patch is a visually distinct color patch within a color bar that is typically printed in the center of the group of patches associated with a particular ink zone. Whereas the typical color patch is a simple rectangle, the master patch's corners are missing in distinct and unique patterns. These patterns form a 4 bit binary encoded value which increments and repeats in a predetermined fashion across the substrate in successive ink zones. The binary code is derived by assigning a place value to each missing corner of the rectangle, allowing 15 unique codes. The 16th code is zero, which is a simple rectangle. The system uses the presence of this binary coded master patch as a confirmation check, along with its color, that the patches are correctly centered in an ink zone. Further, the sequence of the binary codes ensures that the particular group of patches is aligned with the correct ink zone, and not its neighbor. This corrects problems on the printing press caused by lateral movement of the substrate and also deliberate offsets introduced by the press operators to align substrate to various operations on the press unrelated to the UCC.

Once the master patch is located, the imaging assembly is then preferably moved such that the master patch moves to a specific location in the field of view. This operation aligns the imaging assembly to the patch group from a specific ink zone. Next, the imaging assembly is preferably moved along the X axis (in a direction perpendicular to the moving substrate) by one ink zone at a time until the color bar patches disappear. The last location where a valid color bar was found becomes one extreme of the scanned area of the substrate. The opposite end of the substrate along the X axis becomes the other extreme of the scanned area of the substrate. Once these extremes are located and stored, sequential scanning of all of the ink zones commences.

In the color bar mode, color bar location, type and size of the patches are very important factors in accurate and efficient color measurement. It is important for the computer engine to be able to quickly and accurately locate the position of each patch on the color bar from the image provided by the camera. The color bar should be distinguished from the surrounding printed material. Some existing equipment requires that a white border of some predetermined minimum width must surround the color bar. Others use unique geometric shapes or cutouts embedded within the color bar. The recognition algorithm according to the present invention allows the color bar patches to be simple rectangles of any size or proportion specified in advance. Additionally, the surrounding printed material is irrelevant to the recognition of the color bars and may therefore directly adjoin them with no bordering area, i.e. "full bleed".

Figure 2:
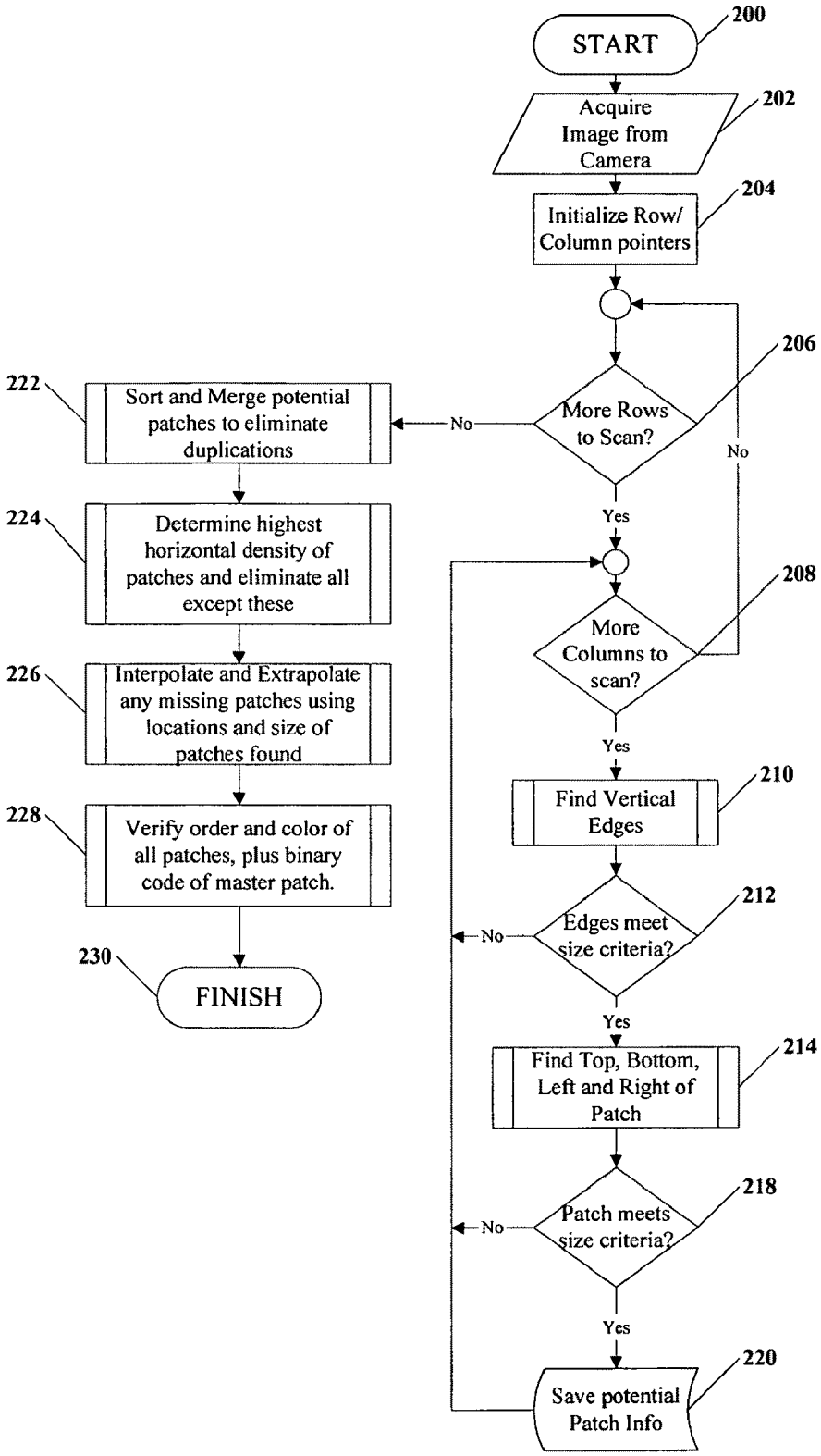
FIG. 2 is a flowchart showing an overview of a color bar recognition process using the inventive color control system.

FIG. 2 is a flowchart representing a recognition algorithm showing the steps for recognizing color bars and color patches. The recognition algorithm assumes the color bar runs horizontally along the width of the substrate. Each patch is the same size and shape as specified in advance. All of the patches for a given key fall into the field of view of the camera at one time, and no two adjacent patches are the same color. Typical size of a color patch is 2 mm along the Y axis and 3.5 mm along the X axis with a 0.5 mm space between adjacent patches.

Color patches in the color bar can be of the solid, n % screened (e.g. 25%, 50%, 75%), clear and one color trapped under another types. The solid patch is normally used for measuring solid ink density. A 50% screened patch is normally used for measuring dot gain. A 75% screened patch is normally used for measuring contrast. A clear patch is used for calculating the unprinted substrate color value. A trap patch is normally used to measure the trap value of one color printed over the other. A three color overprinted patch can be used to measure gray balance, similar to the alternate "gray spot mode" of the invention.

The patches on the color bar can be easily recognized in the acquired image by "edge detection" and "blob analysis" techniques that are well known in the image processing industry. Although the vertical location of the color bar (circumferential relative to the print cylinder) within the printed image is known in advance, differences in substrate tension, and the location of the imaging assembly relative to the position encoder require that a search be conducted to find and center the color bar. In normal operation, an area of +/−four inches from the expected position is searched along the Y-axis (vertically) with the imaging assembly placed in the expected center of the page horizontally. On cue from the counter board, the strobes are triggered for an interval short enough to freeze the image from the passing substrate and long enough to properly saturate the imager with color information. This image is analyzed to determine if any patches are present and qualified in shape, size and quantity. If they are not, a new vertical position, approximately ⅓ of the field of view removed from the first, is computed and another image is taken. This continues through the scan range until a qualified color bar is found or until the operator aborts the search. Since substrate width can change from job to job, UCC also finds the physical end of the color bars to decide the range of ink zones to be scanned for the job.

Color bars are printed on each image produced by the printing press in order to obtain representative samples of target color from each print unit for each individual color, i.e. cyan, magenta, yellow or black without any other color component. This color bar pattern repeats along the X axis for each ink key in the print fountain. These samples are scanned by the camera and the resulting color values are used to determine the correct ink key settings. As discussed above, it is important for the computer to be able to quickly and accurately locate the position of each sample, or "patch", on the color bar from the image provided by the camera.

Once found, the color bar patches are examined for their color values, beginning in a first ink zone and then sequentially through one or more additional ink zones. In each ink zone, the imaging assembly is moved to center the master patch in the field of view. The difference between the actual X and Y location of these patches and the operator programmed location is calculated and used as offsets to align the imaging assembly to the printed information. A previously defined master color patch is identified and its position within the field of view is determined. The imaging assembly is moved horizontally, and the encoder counter board is reprogrammed, to position the master color patch in its correct position within the field of view. The remaining color bar patches are then examined for the correct order. If this final test is passed, the color bar is fully identified. The final position computed for the imaging assembly is then used as a reference for positioning it to image the color bar for any key or any random region of interest on the printed substrate.

The camera next scans the image one ink key width at a time in each direction horizontally until qualified color bars are no longer found. This is used to define the edges of the printed page, and therefore the area to be scanned for color control. For each color bar image acquired subsequently during the scanning process the imaging assembly's reference point is continually "fine tuned" to compensate for variations in the substrate's path through the press. This fine tuning process uses the master patch and color order in the same manner described above.

A special case for calibration is provided for both color bar mode and gray spot mode, where the entire vertical range is searched, and the resulting position is used to establish a "zero reference" or "encoder zero point" for a particular press configuration. Normally this is done when the system is installed, and the established zero reference is stored and used as the start point for all subsequent normal scans, thus speeding the search process considerably. This procedure may be repeated if the timing between the print cylinder and encoder are disturbed for any reason, such as for maintenance.

Whether in color bar mode or gray spot mode, images from the imaging assembly are digitized as "pixels", or points of light of various intensity and color, and these pixels are analyzed for determining color value. Each pixel is composed of a mix of three primary colors, red, green and blue. When mixed virtually any visible color may be produced. Each primary color has 256 possible intensity values; therefore 16,777,216 possible distinct colors may exist. Gray pixels run the range from pure black through pure white and occur where approximately equal amounts of ink are overlapping on the substrate. Because of variation in color register, ink pigments and lighting, plus various electronic distortions and noise, a color area will not always produce the exact same unique color value. The unique method of the invention described herein and including the UCC computer program which is incorporated herein by reference, distinguishes colors to correctly identify each color patch or reference marker as unique to itself and yet different from the background image.

In either the color bar mode or the gray spot mode, the pixels for each camera acquired image are arranged in the memory of the computer as repeating numerical values of red, green and blue in successive memory locations. The acquired image is made of X pixels wide by Y pixels high, and the numeric representation of the pixels repeats regularly through the computer memory thereby creating a representation of the visual image which may be processed mathematically. The exact memory location of any pixel is located by multiplying its Y coordinate by the number of pixels in each horizontal row and again by three, then adding its X coordinate multiplied by 3. For example, if the image is 640 pixels wide (X) and 480 pixels high (Y), and one needs to know the location (M) for the numerical value of the pixel located at 30 (Xv) by 20 (Yv), the formula would be:

$M=(3\times)(Yv)+3Xv$, $M=38{,}490$ for red, 38,491 for green, and 38,492 for blue.

Using this formulation each image of 640×480 pixels requires 921,600 numeric values for a complete representation. The color bar recognition algorithm uses this formula repeatedly to locate pixel values to compare and ultimately determine the X and Y coordinates of each patch in the color bar. The same recognition algorithm similarly locates pixel values for the primary and secondary reference markers, and these steps are described in further detail in commonly owned U.S. Pat. No. 7,187,472.

In the color bar mode, a sub area of the color patch may be considered rather than the entire color patch. The size of the sub area of the patch is determined by the parameters. The average RGB value of the pixels in the sub-area is considered in determining the color value of the patch. For example, for a patch size of 70 pixels×30 pixels, a sub area of 55 pixels×20 pixels in the center of the patch may be considered for determining the average color value of the patch. This prevents color errors from occurring due to camera artifacts and motion distortion.

Accordingly, each patch in a ink zone is typically identified for its color by considering an inspection area smaller than, and contained within, the color patch. Average of all the pixels in this area is calculated for red, green and blue channels. In both the color bar mode and the gray spot mode color correction and conversion from "rgb" to "cmyk" is applied according to the following matrix equation:

$$Z = r + g + b$$

$$\begin{bmatrix} c \\ m \\ y \end{bmatrix} = 255 - \begin{bmatrix} A_r & B_r & C_r \\ A_g & B_g & C_g \\ A_b & B_b & C_b \end{bmatrix} \cdot \begin{bmatrix} r^J \\ g^J \\ b^J \end{bmatrix} + \begin{bmatrix} D_r\left(\frac{r}{Z}\right) + E_r\left(\frac{g}{Z}\right) + F_r\left(\frac{b}{Z}\right) \\ D_g\left(\frac{r}{Z}\right) + E_g\left(\frac{g}{Z}\right) + F_g\left(\frac{b}{Z}\right) \\ D_b\left(\frac{r}{Z}\right) + E_b\left(\frac{g}{Z}\right) + F_b\left(\frac{b}{Z}\right) \end{bmatrix} +$$

-continued $$\begin{bmatrix} G_r\left(\frac{r}{Z-r}\right)+H_r\left(\frac{g}{Z-g}\right)+I_r\left(\frac{b}{Z-b}\right) \\ G_g\left(\frac{r}{Z-r}\right)+H_g\left(\frac{g}{Z-g}\right)+I_g\left(\frac{b}{Z-b}\right) \\ G_b\left(\frac{r}{Z-r}\right)+H_b\left(\frac{g}{Z-g}\right)+I_b\left(\frac{b}{Z-b}\right) \end{bmatrix}$$

$$k = A_k(255-r)+B_k(255-g)+C_k(255-b)$$

where c, m, y, and k (cyan, magenta, yellow and black/gray) represent the primary colors used in printed media, and where r, g and b (red, green and blue) are camera generated color values and represent the primary colors used to represent images within computer media, and the remaining terms represent conversion constants.

Constants in the matrix equation are derived during the calibration process. These constants can change based on changes in color values of standard inks used in a process. Based on corrected r, g and b values for each patch or reference marker, color values (ink densities) are determined based on a empirical data generated using industry standard logarithmic formulas to convert from transformed color values to actual ink density values. These values are compared against target color values for that specific ink zone. If the difference between these two values is outside acceptable limits, a new ink key position is calculated for the ink unit printing that color and the engine communicates this new position to the corresponding PUC.

The imaging assemblies also scan in both directions along the X axis, being moved by the linear drive. The imaging assemblies continue scanning the color bar or reference markers until the press stops printing or the operator changes the mode of a surface from AUTO to MANUAL. The imaging assembly continuously monitors the position of the color bar or reference markers/reference marker pairs and adjusts the Y axis position to keep color bar/reference marker pairs centered in the camera field of view. Any substrate movement along the X axis is also corrected by the engine by keeping track of master color patch/reference marker location within the field of view. If an imaging assembly loses synchronization with the color bar/reference markers for any reason, the color bar/reference marker pair searching procedure is reinitiated.

If the job is configured for gray spot mode, the first task once again is to analyze the image from pre-press information to find the coverage of different colors in different ink zones and preset the ink fountain key openings to get the printed substrate close to the required colors. Ink key opening presets are just an approximation and may not be a perfect setting. The second task is to analyze the color information scanned from the substrate being printed on the press, compare it with the desired color values and make corrections to the ink key openings to achieve the desired color values, i.e. ink density values of each ink in each ink zone. The third task is to continuously analyze the printed substrate and maintain color values of one or more colored image portions throughout the job run length.

In gray spot mode, this third task is accomplished by continuously measuring/analyzing, comparing and controlling the ink density values of one or more pairs of reference markers printed on the planar substrate in each ink zone, which reference markers are positioned adjacent to said one or more colored image portions. In this embodiment, pairs of reference markers are printed on each image produced by the printing press in a pattern that repeats along the lateral axis for each ink key in the print fountain, similar to the printing of color bars described previously. These samples are scanned by the camera and the resulting ink density values are used to determine gray balance and the correct ink key settings therefrom, where the secondary reference marker is processed once for each color present to obtain the density contribution of each primary color component. For example, a three-color reference marker is processed three times to obtain the ink density contribution of each primary color.

As illustrated in FIG. 12A and FIG. 12B, each pair of reference markers comprises a primary reference marker and a secondary reference marker. The primary reference marker comprises black ink, is preferably a halftone, more preferably is a halftone having coverage of greater than 0% but less than 100% (solid), and is most preferably a 50% halftone printed with black ink only. The secondary reference marker comprises one or more of cyan, magenta and yellow ink components, preferably comprising all three of cyan, magenta and yellow inks. However, it should be understood that, the same logic used for these four primary process colors (cyan, magenta, yellow and black) can also be applied to a mixed color of known color values. Each of said primary reference marker and said secondary reference marker has an ink density value, wherein said black, cyan, magenta and yellow inks each have an individual ink density value, and wherein the ink density value of the secondary reference marker equals the combined individual ink density values of the one or more cyan, magenta and yellow inks. Individual ink density measurements are derived according to the methods discussed in commonly owned U.S. Pat. Nos. 7,187,472 and 7,477,420, the teachings of which are described in detail herein. The steps for achieving color value/ink density determination in an acquired frame image are summarized in FIGS. 12 and 13.

When the colors of the two reference markers are in balance, both dots will produce identical values for reflected ink density, and such is preferred. Further, when all three of the primary colors cyan, magenta and yellow are present in the secondary reference marker and the individual ink densities of said primary colors are all equal, the secondary reference marker will appear as neutral gray in color. If only one or two of said primary colors are present, or if all three are present but their individual ink densities are not equal, then the secondary reference marker may not appear as a neutral gray. For example, if fewer than all three primary colors are used for the secondary reference marker its color will not be a neutral gray, but rather a tint.

The system of the invention allows for tint correction by changing (increasing or decreasing) the individual ink density, or "target density", for a specific primary color. The contributing individual ink densities may still be derived for these tints but the target density values will be unknown without experimentation or previous measurement by the operator, rather than being known already from pre-press information. Once these individual target densities are determined, automated control may proceed as outlined. Specifically, ink film thickness, controlled via conventional ink fountain keys, is adjusted to achieve the desired color. Overall color saturation may be adjusted by changing the black ink density, and compensating the other colors in proportion to maintain the reasonable match.

Each of the reference markers in each reference marker pair may be circular or another shape, with a nominal 1.5 mm (~0.06") diameter. Reference markers smaller and larger than 1.5 mm may also be used for the process control, but approximately 1.5 mm is most preferred. Circular reference markers are also most preferred because they do not tend to draw the eye to themselves, and obscure and unobtrusive gray dots that do not attract the eye are desired. Square, rectangular or triangular reference markers are more apparent and therefore less desirable, but they will work to control the color with no difference compared to round markers. The reference markers are differentiated from other random print on the page by their geometry and spatial orientation. As illustrated in FIG. 13, one pair of reference markers are preferably located in each ink zone and the reference markers preferably lie along an approximate straight line running perpendicular to the direction of motion of the substrate, and are preferably a specific distance from one another along said line. It is also preferred that the reference markers are printed on a contrasting monotone background, preferably with no other print in-between the markers. It is also preferred that color to color registration be of such quality as to eliminate color fringing and shape distortion. Detection of color fringes around the edges of the reference markers will preferably immediately halt processing and control of the reference markers. For example, the system is looking for monotone markers, and out of register conditions will distort the shape of the marker. If it is distorted and monotone area of the correct shape and size is not recognized, no marker will be found. When more than a given percentage of markers are not recognized, the system assumes that there is a problem and the system automatically reverts to the manual mode where printing will continue but the color adjustment process is halted.

As discussed above with regard to the color bars, it is important for the computer to be able to quickly and accurately locate the position of each reference marker in a reference marker pair from the image provided by the camera. This includes the ability to recognize and adjust for any physical movement of the substrate during the printing operation. Accordingly, similar to the odd shaped master patch used in conjunction with color bars in color bar mode, camera position in gray spot mode may be verified by a unique geometric shape located in the otherwise blank space in-between or relative to the primary reference marker and secondary reference marker. In gray spot mode, these unique geometric shapes are referred to herein as "position markers". The shape of the position markers should be different than the shapes of the primary and secondary reference markers, and should be positioned at a known distance from each of the primary and secondary reference markers. As illustrated in FIG. 12B, a preferred position marker comprises a thin vertical line, because a thin line would be unobtrusive, which is desirable for the reasons previously stated. Preferably, this thin vertical line is centered between and equidistant from each of the primary reference marker and secondary reference marker in one or more of said reference marker pairs. Additionally, although thin vertical lines are preferred for said position markers, other shapes would work sufficiently as well. Position markers may also be used in one or more locations across the substrate.

In the gray spot mode, the position marker is used in the manner as the master patch in the color bar mode to verify the lateral position of the primary reference marker and/or the secondary reference marker on the substrate relative to the position/location of the position marker. As the camera scans the ink zones across the substrate, it verifies that position markers exist in the correct places and any offset in the physical position of the substrate locator mark is noted. These offsets are considered for accurately positioning the imaging assembly to keep alignment between the imaging assembly position and printed area corresponding to the ink zones. This may be performed on a regular basis to ascertain the alignment between the imaging assembly position and printed area corresponding to the ink zones to maintain image synchronization. If the markers are not in the expected locations, no processing will occur to prevent incorrect color adjustment, and the system will go back into the search mode to verify that it is scanning the correct markers.

Scanning and/or color adjustment of the reference markers may be halted if it is recognized that the reference markers are out of registration, if position markers are in unexpected positions, or if position markers are missing where they are expected. More than a predetermined number of these errors will preferably immediately halt processing and control. Pantone Matching System (PMS) or other non-process (non-primary) colors are generally not controlled automatically in this mode. However, they may be printed on the page under manual operator control, but must not be included in any of the defined reference or position markers.

As stated above, the user interface allows the operator to select three different startup modes: "Ideal", "Current" or "Last Used". The operator may also override the settings across the page, or in zones as small as a single ink zone. Individual color ink density target values may be changed to effect the overall tint of the image, and all density targets may be moved together to effect the overall color saturation. The operator may also assign primary colors to various printing units to suit the needs of the press and the job. The invention also includes a special "Follow Black" mode that allows the ink density targets for all contributing primary colors to proportionately follow the black ink density target. Compensation is also available for various paper types. Since different papers absorb inks differently, a library of paper types is kept on the controlling computer. This is important because paper types define 1) the target densities for each contributing primary color in an image; 2) the overall reaction of the system to color variation to allow smooth overall control of the printing process; and 3) the native tint of the blank paper.

Regardless of the mode selected, when changing ink key positions on the printing press there is typically a delay from the time a change in ink key position is initiated to the time the full effect of that change shows up on the substrate. Typical delays on a web offset printing press can be 500 impressions, where one impression is equal to one rotation of the printing cylinder. In the preferred embodiment of the invention, when the engine makes a change in a specific ink key position, it will wait for this delay to expire, and then further wait until the measured color stabilizes before making further changes to that specific key.

Further, if the press speed drops below a specified speed, as defined by a parameter typically set during installation, the imaging assemblies stop scanning and they are parked to one of the extremes along X axis. If the engine is in AUTO mode, scanning and key movements will resume after the appropriate delays once the press speed is restored to normal.

When an imaging assembly is scanning a specific surface, the operator can preferably touch a VIEW key on the console touch screen to see the acquired image on the console monitor. In this mode, images are updated as the imaging assembly scans across the substrate along the X axis. The operator can preferably request an image of a specific ink zone by touching the appropriate buttons on the touch screen. The operator can also request the image of a specific region of interest (ROI) specified by the operator as X and Y coordinates on the substrate. Any number of ROI areas may be specified during the job setup or during the run in AUTO mode. When a specific image is requested, following actions take place:

1. Sequential scanning of keys on the corresponding assembly is temporarily halted.
2. The corresponding imaging assembly is positioned to the X (lateral) location of required image.
3. The encoder count number corresponding to the Y (circumferential) location of the required image is loaded in the counter board.
4. An image is acquired and stored in the engine for further processing.
5. The image is passed to the console and displayed on the screen.
6. Normal key scanning resumes where it left off.

At this point, the operator can touch anywhere on the displayed image. UCC then calculates the average density of all the pixels within the specified area and displays it on the screen. ROI dimensions can also be changed by changing motorized zoom and focus in the camera.

UCC is built with statistical quality monitoring (SQM) features. Color value data (ink density data) is stored at the end of each pass across the width of the substrate in various industry standard formats. This data is displayed on the screen, preferably in the form of a graph. This data is also preferably available on the Ethernet network and the customer can import this data directly into commercially available statistical quality control, database or other software of their choice.

Other maintenance functions are also preferably provided to save the current position of all keys on all ink fountains in the system, and open or close ink fountains to a predetermined value. When normal operation is resumed, the keys on these fountains would return to the last saved values.

Changing the encoder belt is a maintenance procedure which may disturb the encoder timing in relation to the print cylinder. Accordingly, UCC has an encoder teach mode feature. When this feature is activated for a specific surface, the present UCC system searches for the color bar/reference marker pairs within the entire possible Y axis positions. When a color bar/reference marker pair is found, the offset from encoder index pulse is calculated and saved.

Due to the aforementioned disadvantages of color bars, if a color bar is necessary, it is desirable to have the smallest possible color bars. During the start of the printing process, two factors affect the print quality the most—register and color. It is also well known that most automatic register control systems cannot identify register marks unless the color for the marks is correct and the print is clear. One preferred automatic register control system that can properly identify such register marks described in commonly owned U.S. Pat. No. 6,621,585, the disclosure of which is incorporated herein by reference. Most color controls have problems recognizing color bars due to register error between colors. Automatic register control and color control work sequentially instead of working in parallel. In such cases, performance of one affects the performance of the other. The overall effect of this interdependence is increased waste.

The color register control of the invention is based on shape recognition, so it is very tolerant to the print quality and color of the printed register marks. A color bar recognition algorithm is provided that is very tolerant to color register error. Operating in the gray spot, UCC does not need a color bar. The combination of these technologies provides the best performance since both controls work in parallel.

As explained previously, the image available from pre-press is analyzed during job setup. Typical information available from pre-press in CIP3 format is arranged in layers of different color separations, each layer representing one printed color. A combination of all color separation layers makes the complete image being printed on the press. Each color separation layer is divided into ink zones that are aligned with the ink keys on the printing press, such that the width of the ink zone is equal to the width of ink key and the length of each ink zone is equal to the circumference of the printing cylinder. This information is used to calculate the initial key settings for each ink zone for each color being printed.

The size of the image acquired by imaging assembly is typically 2.00" wide×1.50" high. Color densities are calculated for each color in each reference marker or color patch as the imaging assembly continuously scans the markers/patches to determine actual color values. At the end of each pass, the color densities are updated and any differences between the target and actual color density are calculated. Based on these differences, ink keys in corresponding zones are opened or closed to maintain constant color.

The invention can be further understood through FIGS. 1-13 of the invention which are described in detail as follows:

Looking to the figures, FIG. 1 provides a system overview of the invention. The system preferably comprises an engine 100. The preferred engine functions include communications 102, press control 104 and image analysis 106. The communications 102 function takes care of the communications between the engine and all peripherals attached to the engine. The press control 104 function provides control signals for moving the ink adjusting mechanism on the press. The image analysis 106 function analyzes the image acquired from the imaging assembly 116. Three modes of communication are provided for the engine to communicate with various peripherals attached to the engine. An industry standard Ethernet backbone network 128 is provided to communicate with a pre-press server 130, a system management and statistical reporting workstation 132, printers 134 and single or multiple user consoles 136, 138. An industry standard IEEE 1394 bus 124 is provided to communicate with one or more digital color cameras 122, to pass instructions to the camera(s) and also to acquire image information from the camera(s).

One imaging assembly 116 is provided for each surface of substrate. An imaging assembly comprises a positioning motor 118, 620, see also FIG. 6, for positioning the assembly across substrate 650. Each imaging assembly also comprises a digital color camera 122 and a strobe assembly 120. The strobe illuminates the field of view for a very short period of time and the image is acquired by the camera. Strobe illumination is synchronized with the position of camera in relation to the substrate by an input trigger signal from an encoder and counter board 126. The same trigger signal is also transmitted to the camera to synchronize image acquisition with strobe illumination. One encoder 126 per substrate is provided to get the position information for timing the image acquisition with the printed substrate.

The network backbone 140 provides communication between the engine and one or more print unit controllers 108 and also between the engine and the imaging assembly 116. One Print Unit controller 108 is preferably provided per printing unit on the printing press. The print unit controller 108 preferably provides functions for key control 110, ink stroke control 112, and water control 114, and one print unit controller may control one or more sets of ink fountain, ink stroke control and water control. Depending on the printing process and printing press design, ink stroke control 112 and water control 114 may or may not be built into the system. Since print unit controller architecture changes between different presses and press manufacturers, the communications between the engine and the PUC may be performed using other industry standard backbones like, Ethernet, Arcnet, Profibus, RS232, RS485, etc., as required.

FIG. 2 gives details about color bar recognition process 200. When UCC is used in a "color bar mode", this process is used to identify color bar and color patches corresponding to each ink zone on the substrate. The process is also used when the operator programs UCC system for a "gray spot mode" and when UCC gets press interface signals to start the process. An image is acquired 202 according to the process explained in FIG. 11, beginning with a first ink zone and then proceeding sequentially. The image information thus acquired is transmitted to the UCC computer. This stored image is digitized as pixels.

The image thus acquired is further analyzed for each row 206 and each column 208. Areas of a single color are marked as possible patch locations. For each possible location of a color patch, the top and bottom vertical edges are found 210. If the distance between the top and the bottom edge meets the patch size criteria 212, then precise top, bottom, left and right edges for the patch are found 214. From this information, precise size of the patch is determined. Edge detection algorithms are well known in the image processing industry. If this size meets the patch size criteria 218, this can be a potential patch along the color bar and its location and color information is stored for future use 220. This process is repeated to find all potential patches in the acquired image.

When all potential patches are identified in the image, first they are sorted and merged to eliminate duplicate potential patches 222. Then, the highest concentration of patches along the X direction are found from these patches and all others are rejected 224. Based on the location and size of these patches, any missing patches are interpolated and extrapolated 226. Next, the binary code of the master patch is identified and compared with the location corresponding to this ink zone 228. Also, the color of each patch is identified and compared with the color order configuration set by the press operator during job defining process. At the end of this process 230, the information in the acquired image for each color patch along the color bar is available for further color analysis.

Figure 3:
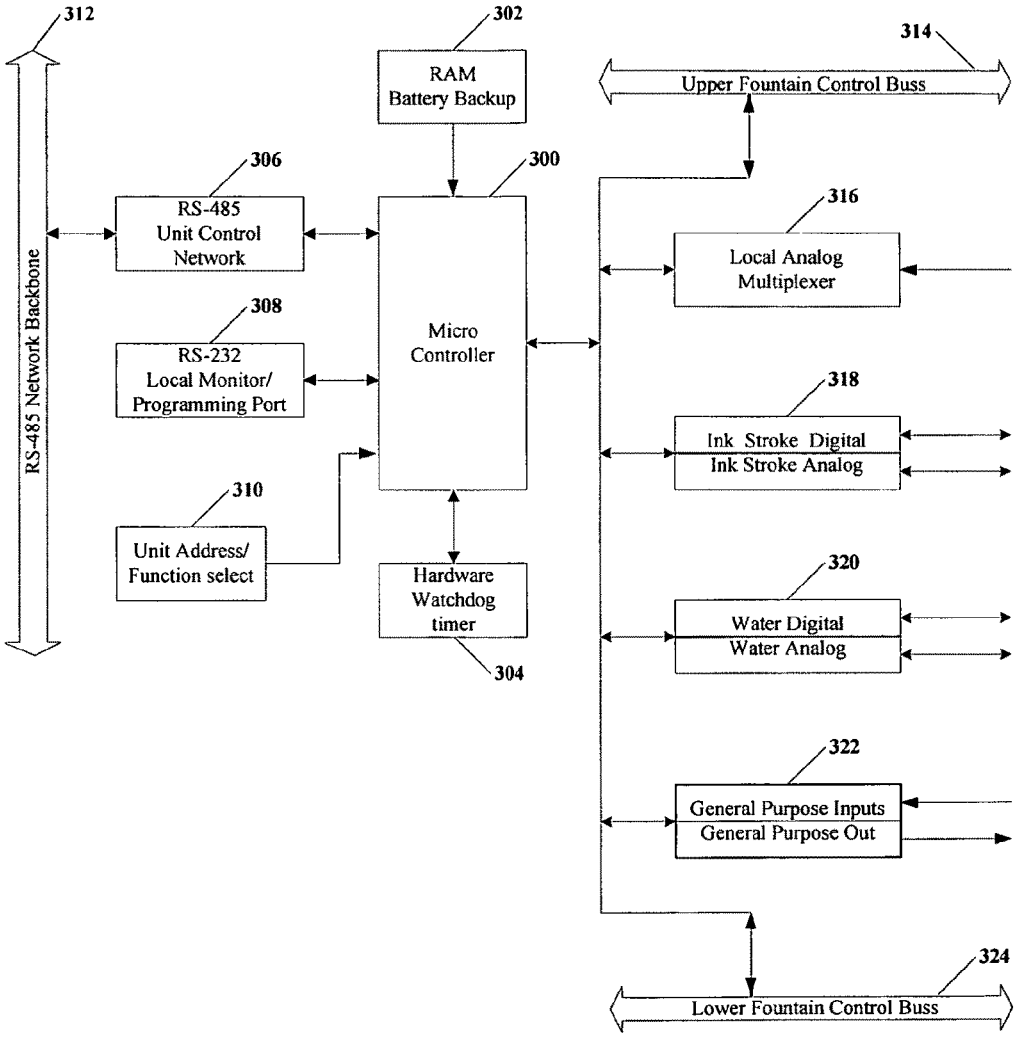
FIG. 3 is a block diagram of a print unit controller for the inventive color control system.

FIG. 3 gives further details about a print unit controller 108. It comprises a micro controller 300 for logic control. A RAM battery backup 302 is provided to save memory value in case of power loss. A hardware watchdog timer 304 is provided to continuously monitor for reliable operation of print unit controller operation. RS-485 unit control network 306 hardware is provided to communicate with a RS-485 network backbone 312, 140. Additional hardware is provided for an RS-232 local monitoring and programming port 308. Unit address and function select 310 hardware is provided to individually address each print unit controller. Each print unit controller can control two ink fountains on a printing press. Upper fountain control buss 314 and lower fountain control buss 324 are connected to the micro controller 300. The micro controller is also attached to ink stroke 318 and water 320 Input/Output hardware equipped for either analog or digital signal input/output interfacing. General purpose inputs and outputs 322 are provided for interfacing with various other events and functions on a printing press. A local analog multiplexer 316 is provided for reading analog signals from various inputs on the processor board.

Figure 4:
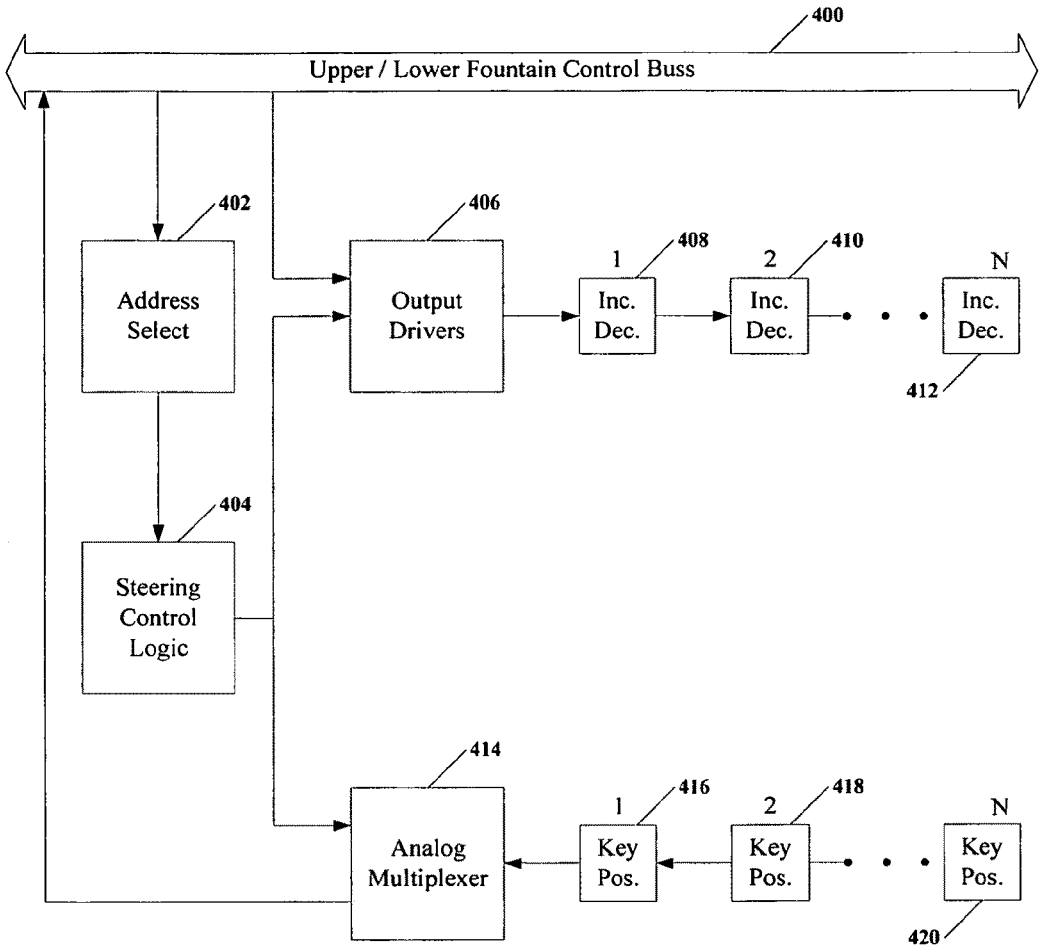
FIG. 4 is a block diagram of an upper/lower fountain control buss operation for a fountain key adapter for the inventive color control system.

FIG. 4 gives further details about upper/lower fountain control buss 314, 400 operation for a fountain key adapter. Each fountain key adapter can adjust the position of a plurality of ink key actuators and it can also read the position for the corresponding ink keys. An address select 402 switch is provided to cascade fountain key adapters to provide control for a plurality of ink keys. Steering control logic 404 selects operation on the top or the bottom fountain. Output drivers 406 switches ink key actuators 408, 410, 412 power to open or close the ink key. Analog multiplexer 414 reads the ink key 416, 418, 420 positions.

Figure 5:
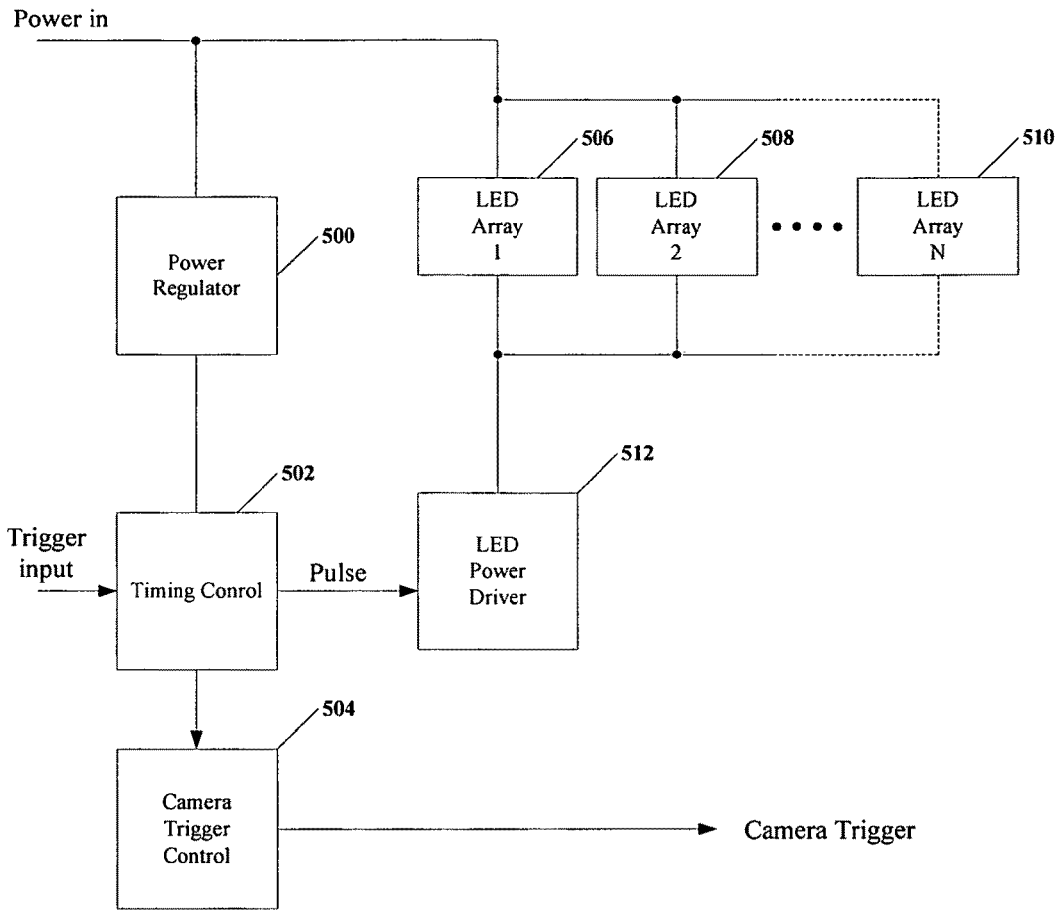
FIG. 5 is a block diagram of strobe and camera control functions.

FIG. 5 provides details about strobe operations. Power is supplied to the strobe assembly through a power regulator 500. A trigger input to the circuit is used to synchronize strobe illumination with image acquisition. The strobe illuminates for a fixed time synchronous to the trigger input pulse. Timing control 502 provides the logic for timing between trigger input and illumination. One or more LED arrays 506, 508, 510 can be attached to the LED power driver assembly 512. Each LED array can have one or more LEDs for illumination. Timing control 502 also interfaces with camera trigger control 504. Camera trigger control processes the timing signal from timing control and provides a camera trigger signal appropriate for triggering the camera for image acquisition.

Figure 6B:
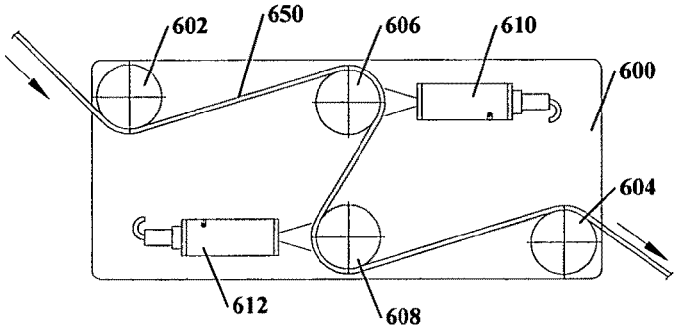

FIG. 6A illustrates the apparatus for systematically scanning the image from the substrate 650. It is composed of two frames 600. A web lead-in roller 602 is provided to accept the substrate 650 from previous process equipment. A web lead-out roller 604 is provided to deliver the substrate to the next process equipment on the printing line. Between lead-in and lead-out rollers, the substrate travels over two rollers 606, 608. The imaging assembly comprising a color camera and a strobe light 610 scans the top side of the substrate passing over the roller 606. The imaging assembly comprises a color camera and a strobe light 612 scans the bottom side of the substrate passing under roller 608. Both imaging assemblies 610, 612 are mounted on a carriage 614, which moves and positions the imaging assembly to operator specified locations across the substrate width. The carriage 614 is equipped with v-groove guide wheels and the guide wheels keep the camera on the guide 616. The carriage is also equipped with a linear drive in the form of motor 620 and a timing belt pulley installed on the shaft of the motor. A timing belt 618 is provided across the width of the carriage guide. Rotation of the motor 620 on the belt moves the carriage 614, motor 620 and imaging assembly 612, 614 across the substrate. The carriage guide is mounted on the mounting brackets 622, which are subsequently mounted on the frames 600. FIG. 6B presents a side view of the equipment described above.

FIG. 7 provides details about the color bar configuration. The color bar consists of color patches arranged in a row along the X direction of the substrate, from one end to the other end. The space on the color bar corresponding to each ink zone can have up to 8 color patches. Each patch can be printed with a solid color, a % tint of a color, a white space or an overprint of one color on top of the other color. More patches can be accommodated if the patches are made smaller or if the patches are stacked in multiple rows. In order to assure correct alignment of the imaging assembly to the printed substrate, the color bar area in each ink zone includes a centrally located master patch. The group of color bars traversing all of the ink zones across the substrate is frequently referred to simply as "the color bar".

Figure 8A:
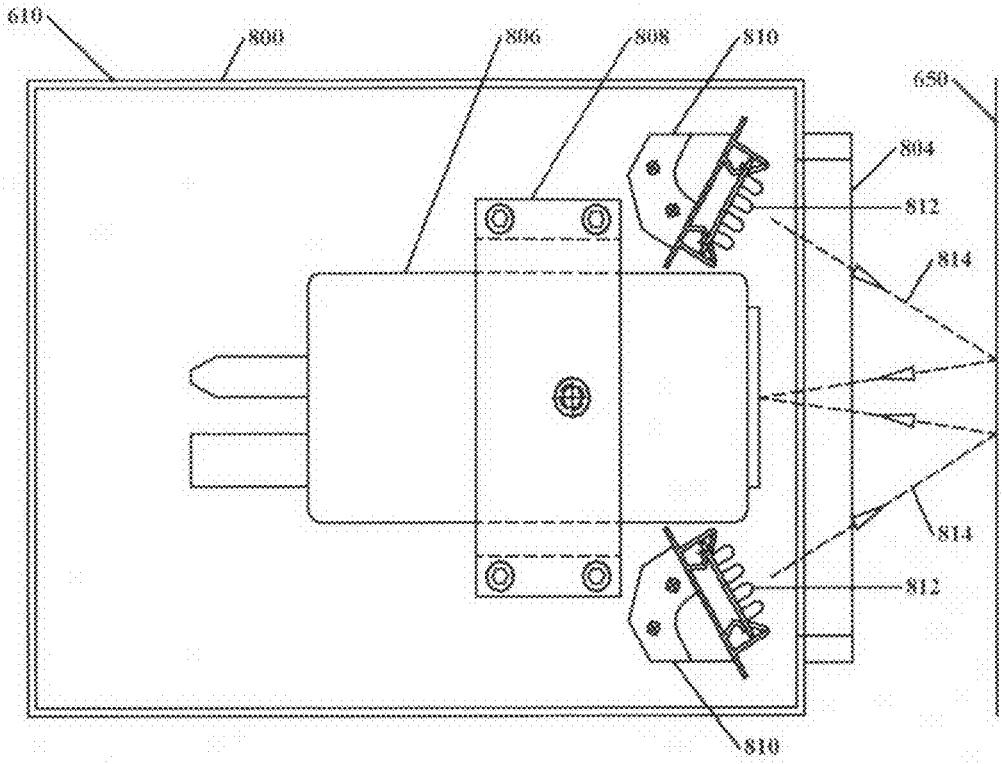
FIG. 8A is side perspective view of an imaging assembly according to the invention.
Figure 8B:
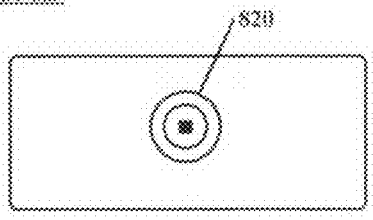
FIG. 8B and FIG. 8C show single and multiple light source strobes respectively.
Figure 8C:
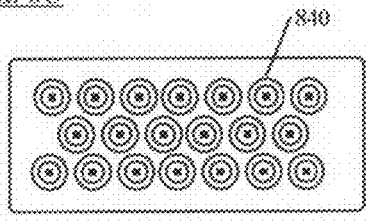

FIG. 8A is side perspective view of an imaging assembly 610 according to the invention, which is the same as imaging assembly 612 as shown in FIGS. 6A and 6B. It comprises color digital camera 806 and two strobes 812 enclosed in an enclosure 800. The camera 806 is mounted inside enclosure 800 by mounting brackets 808 and the strobes are mounted inside enclosure 800 by mounting brackets 810. The enclosure has a clear window with a non-reflective coating 804 in front of the camera lens. The strobes illuminate the substrate 650. Light rays 814 from both strobes originate at the strobe LEDs and reflect back from the substrate and enter the camera lens. Each strobe may have a single light source, 820 as shown in FIG. 8B or an array of light sources 840 as shown in FIG. 8C.

Figure 9:
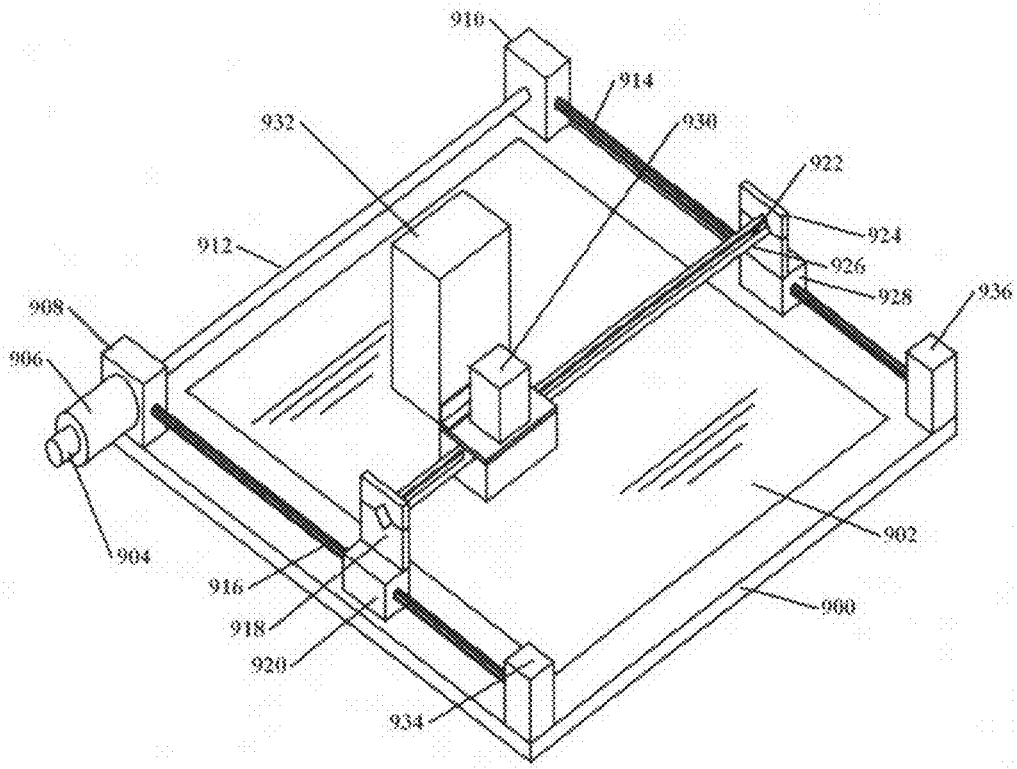
FIG. 9 illustrates an arrangement with a stationary substrate and a moving imaging assembly.

FIG. 9 describes an arrangement where the substrate is stationary and the imaging assembly 932 is mounted on a carriage with positioning motor 930. In this embodiment, the linear drive comprises two portions, one which moves the imaging assembly in the X axis direction and one which moves the imaging assembly in the Y axis direction in relation to the plane of substrate 902. The carriage moves on a rail 926 across the width of substrate 902, also known as the X axis. A fixed timing belt 922 is anchored to the supports 924, 918. A rail is also supported on two ends with supports 924, 918. Supports 918, 924 are mounted on brackets 920, 928 with nuts. The whole subassembly travels along the Y axis on two screws 914, 916. Both screws are supported on one end with brackets 934, 936. The other end of both screws is driven by bevel gear assemblies 908, 910. Bevel gear assemblies 908, 910 are coupled together with a shaft 912. Both bevel gear assemblies are driven by a positioning motor 906. An encoder 904 is attached to the motor shaft to give feedback for the Y axis position of the imaging assembly. The whole assembly is mounted on a base 900 which also serves as a support for substrate 902. In this arrangement, the substrate is held stationary and imaging assembly moves in both the X and Y orthogonal directions in relation to the plane of substrate 902.

FIG. 10 illustrates the typical nature and layout of print and ink zones on the substrate. An image is repeatedly printed on the substrate 1014, where the print repeat length 1006, 1012 is equal to the circumference of the printing cylinder. This direction is generally known as circumferential direction or a Y direction. The width of the printed substrate 1004, 1010 is generally known as lateral direction or X direction. In a typical printing press, an ink fountain provides the ink for printing operation. The ink fountain has several ink keys across the width of the fountain. Each ink key can be individually opened or closed to allow more or less ink in the corresponding longitudinal path of the substrate, called an ink zone 1008. Ink, from the ink fountain, travels along the ink train through distributor rollers. Any change in the ink key setting affects the whole longitudinal path, or ink zone, aligned with the key. A typical printing press also has oscillator rollers. In addition to the rotational motion, these oscillator rollers also have lateral motion moving back and forth. The axial motion spreads ink along the ink zone to the adjacent ink zones. The height and width of the acquired image 1000 is shown in the figure. Although the typical width of the image is 640 pixels and the height is 480 pixels, a different camera resolution can also be used for the application. Due to distortion and uneven lighting along the edges of the acquired image, a sub area of the image 1002 is used for the color analysis. This area is also called the image aperture. The aperture width reflects the actual width of the ink key.

FIG. 11 gives details about the image acquisition process in UCC, 1100, for getting color information for each ink zone. This is a general process and it is used to acquire an image of the substrate in "color bar mode" as well as in the "gray spot mode". The process starts by positioning the imaging assembly at a desired location along the X direction, 1102. This is done by providing commands to the positioning motor and an integrated controller that keeps tracks of the imaging assembly position along the X direction. The location of the first image in Y direction is specified by calculating the encoder value of the first location and setting that value into the Counter Board 1104 preset. Now, the camera is armed 1106 to acquire the image when it receives the next trigger signal. Hardware in the counter board keeps track of the encoder shaft location, which is attached to a print cylinder. Thus the encoder shaft location provides precise timing information about the printed substrate location in Y direction. When the encoder count in the counter board matches with the preset count, the counter board generates a trigger signal 1108. The trigger signal is processed by the strobe board and it illuminates the LED array for a very short time 1110. This processed signal is also used to start image acquisition on the color camera 1112. The image acquired by the camera is transmitted to the UCC computer and it is stored for further analysis 1114. Operating in either "color bar mode" or "gray spot mode", the process is finished for this ink zone 1118 and the imaging assembly may proceed further to get information about the next ink zone.

FIGS. 12A and 12B show a schematic representation of the gray spot configuration. A primary marker 1201 and a secondary marker 1202 are printed in each ink zone across the page laterally. The primary marker 1201 contains the black ink and the secondary marker 1202 contains the ink from the other printed process colors. In several locations across the page, the markers preferably include a camera position marker 1203 which is used to verify the position of the camera over the printed substrate.

FIG. 13 shows a schematic representation of a substrate 1301 including the locations of the reference markers 1304 across ink zones 1303. The substrate moves in a direction of travel 1302 through the printing press parallel with the ink zones 1303 and perpendicular with the reference markers. Each set of reference markers is contained in its own clear space on the substrate 1301.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

APPENDIX

Computer program listing appendix referenced, included and incorporated in the present application which is included in a single compact disk CD-ROM labeled "UNIVERSAL CLOSED LOOP COLOR CONTROL", which is submitted in duplicate. The file size, creation date and file name on the compact disk CD-ROM appendix includes the following 115 files:

| SIZE | DATE | TIME | FILENAME |
|---|---|---|---|
| 174,226 | Feb. 12, 2010 | 3:25 PM | cccStructures.bas |
| 88,450 | Feb. 12, 2010 | 5:48 PM | cccConGlobal.bas |
| 12,282 | Oct. 8, 2007 | 4:26 PM | frmAutoLock.frm |
| 10,555 | Feb. 16, 2004 | 9:40 AM | frmCalTScreen.frm |
| 180,566 | Feb. 8, 2010 | 4:48 PM | frmCIP.frm |
| 3,134 | Apr. 27, 2009 | 3:39 PM | frmCIPerror.frm |
| 2,074 | Apr. 27, 2009 | 3:40 PM | frmCIPImage.frm |
| 50,135 | Nov. 20, 2009 | 11:21 AM | frmColorEdit.frm |
| 26,408 | Feb. 12, 2009 | 9:47 AM | frmControls.frm |
| 5,892 | Jul. 7, 2009 | 10:07 AM | frmCutoff.frm |
| 14,933 | Apr. 17, 2007 | 8:40 AM | frmDateTime.frm |
| 167,788 | Jun. 19, 2009 | 10:20 AM | frmDensity.frm |
| 27,019 | Nov. 21, 2008 | 4:29 PM | frmFaultDisp.frm |
| 58,182 | Dec. 23, 2009 | 4:12 PM | frmFile.frm |
| 17,613 | Aug. 12, 2005 | 3:49 PM | frmGraphTypeSelect.frm |
| 26,102 | Oct. 18, 2004 | 4:59 PM | frmHeadPanel Oops.frm |
| 32,504 | Mar. 25, 2009 | 8:01 AM | frmHeadPanel.frm |

-continued

| SIZE | DATE | TIME | FILENAME |
|---|---|---|---|
| 1,039 | Feb. 16, 2004 | 9:40 AM | frmHidden.frm |
| 24,891 | Jan. 30, 2008 | 9:21 AM | frmJobScan.frm |
| 63,628 | Dec. 23, 2009 | 1:52 PM | frmKeyboard.frm |
| 95,643 | Jun. 19, 2009 | 10:16 AM | frmKeyConfig.frm |
| 85,682 | Jan. 8, 2010 | 11:55 AM | fnnKeypad.frm |
| 28,384 | Jun. 29, 2004 | 8:53 AM | frmKeyPop.frm |
| 42,196 | Feb. 17, 2004 | 3:36 PM | frmKeys old.frm |
| 63,309 | Jan. 8, 2010 | 11:54 AM | frmKeys.frm |
| 21,946 | Apr. 11, 2007 | 3:18 PM | frmLearnPreset.frm |
| 10,221 | Apr. 11, 2007 | 3:18 PM | frmLearnSurfComp.frm |
| 3,289 | Feb. 16, 2004 | 9:40 AM | frmLogin.frm |
| 6,041 | Jun. 21, 2006 | 2:59 PM | frmMain.frm |
| 63,259 | Jan. 26, 2010 | 2:10 PM | frmMainten.frm |
| 4,944 | Oct. 26, 2004 | 5:04 PM | frmMessageWindow.frm |
| 41,453 | Feb. 16, 2004 | 9:40 AM | frmOffsets.frm |
| 2,610 | Oct. 10, 2006 | 2:54 PM | frmOTS.frm |
| 143,352 | Jun. 17, 2009 | 3:14 PM | frmParams.frm |
| 9,699 | Feb. 16, 2004 | 9:40 AM | frmPassword.frm |
| 114,110 | Jan. 8, 2010 | 3:38 PM | frmPress.frm |
| 5,036 | Dec. 10, 2009 | 11:52 AM | frmReset.frm |
| 1,795 | Dec. 28, 2009 | 2:24 PM | frmRestart.frm |
| 10,205 | Mar. 28, 2007 | 10:35 AM | frmShutdown.frm |
| 12,055 | Jan. 4, 2010 | 11:15 AM | frmSplash.frm |
| 68,141 | Jan. 4, 2010 | 11:09 AM | frmStat.frm |
| 42,780 | Feb. 5, 2010 | 4:25 PM | frmSurfAssign.frm |
| 105,373 | Sep. 14, 2006 | 9:16 AM | frmTarget xxx.frm |
| 126,382 | Nov. 20, 2009 | 11:21 AM | frmTarget.frm |
| 85,596 | Feb. 16, 2004 | 8:40 AM | frmTargetxxx.frm |
| 4,880 | Jun. 10, 2008 | 3:02 PM | frmTips.frm |
| 41,318 | Feb. 16, 2004 | 9:40 AM | frmView.frm |
| 2,904 | Jul. 19, 2004 | 2:05 PM | frmWarning.frm |
| 10,159 | Feb. 16, 2004 | 9:40 AM | frmYesNo.frm |
| 79,820 | Jan. 20, 2009 | 11:16 PM | frmZoom.frm |
| 70,365 | Feb. 16, 2004 | 9:40 AM | frmZoomx.frm |
| 12,537 | Nov. 22, 2008 | 12:40 PM | HTMLHelp.bas |
| 1,137 | Mar. 7, 2006 | 5:09 PM | JobScanGlobal.bas |
| 4,942 | Feb. 7, 2002 | 2:52 PM | modToolTip.bas |
| 30,759 | Dec. 28, 2009 | 2:06 PM | tcpClient.frm |
| 1,717 | Sep. 3, 1999 | 1:32 PM | WinHelp.bas |
| 1,505 | Jun. 13, 2005 | 10:08 AM | ArcnetDeclarations.bas |
| 12,425 | Jul. 14, 2008 | 1:31 PM | ArcnetMonitor.frm |
| 131,806 | Dec. 11, 2009 | 4:08 PM | Cal.frm |
| 36,544 | Dec. 14, 2009 | 10:02 AM | CameraControl.frm |
| 13,713 | Dec. 14, 2006 | 4:08 PM | CameraProps.frm |
| 1,212 | Nov. 10, 2004 | 10:05 AM | DebugPic.frm |
| 38,869 | Feb. 20, 2007 | 12:14 PM | eltromat Comm.frm |
| 43,339 | Jul. 16, 2008 | 3:49 PM | EltromatZircon Comm.frm |
| 202,227 | Dec. 30, 2009 | 2:44 PM | EngCode.bas |
| 9,839 | Jun. 10, 2009 | 12:46 PM | EngDeclarations.bas |
| 8,746 | Jun. 10, 2008 | 9:55 AM | EngVariables.bas |
| 36,677 | Apr. 30, 2008 | 3:10 PM | EPG Comm.frm |
| 18,950 | Dec. 3, 2009 | 2:31 PM | FountCal.frm |
| 9,865 | Jul. 10, 2008 | 4:56 PM | frmArcnetTestMain.frm |
| 2,378 | Apr. 7, 2008 | 2:27 PM | frmDebug.frm |
| 4,712 | Dec. 2, 2009 | 2:41 PM | frmExersize.frm |
| 9,058 | Sep. 7, 2007 | 10:20 AM | frmLAB.frm |
| 1,460 | Nov. 14, 2008 | 4:41 PM | frmNothing.frm |
| 1,600 | Dec. 10, 2008 | 4:18 PM | frmRX.frm |
| 48,201 | May 19, 2006 | 4:04 PM | GCX Comm.frm |
| 59,041 | Aug. 18, 2009 | 8:19 AM | GMI Comm.frm |
| 48,737 | Nov. 9, 2006 | 3:57 PM | KBA Comm.frm |
| 9,714 | Jun. 24, 2005 | 5:05 PM | KBA KeyControlCommon.bas |
| 13,691 | Dec. 2, 2009 | 11:27 AM | KeyControlCommon.bas |
| 42,996 | Oct. 10, 2008 | 10:13 AM | MM Canbus Comm.frm |
| 35,915 | Sep. 11, 2006 | 10:48 AM | Monigraf Comm.frm |
| 103,065 | Dec. 2, 2009 | 11:27 AM | Perretta Comm.frm |
| 56,713 | Apr. 24, 2009 | 4:32 PM | PerrettaNet.frm |
| 36,228 | Feb. 16, 2004 | 10:42 AM | PressControl.frm |
| 11,578 | Feb. 16, 2004 | 10:42 AM | Recognize.frm |
| 17,093 | Feb. 16, 2004 | 10:41 AM | RecognizeStructs.bas |
| 42,981 | Feb. 16, 2004 | 10:42 AM | RS485.frm |
| 64,386 | Feb. 5, 2010 | 11:29 AM | Rutherford.frm |
| 477 | Apr. 2, 2008 | 4:08 PM | RutherfordDeclares.bas |
| 112,697 | Feb. 12, 2010 | 3:22 PM | StatusForm.frm |
| 35,322 | Jun. 26, 2008 | 1:38 PM | T2 Comm.frm |
| 24,095 | Dec. 14, 2009 | 11:27 AM | TCP.frm |
| 95,319 | Nov. 20, 2008 | 4:09 PM | TigerComm.frm |
| 2,490 | Mar. 19, 2001 | 5:30 PM | 20020drv.h |

-continued

| SIZE | DATE | TIME | FILENAME |
|---|---|---|---|
| 4,250 | Jun. 10, 2005 | 9:27 AM | 20020sys.h |
| 6,846 | Jun. 16, 2005 | 1:46 PM | Arcnet.cpp |
| 34,084 | Dec. 23, 2009 | 10:56 AM | CameraDLL.cpp |
| 1,819 | Aug. 10, 2006 | 11:12 AM | CameraDLL.h |
| 2,489 | Jun. 7, 2001 | 3:39 PM | ficamera.h |
| 4,590 | Jun. 14, 2001 | 3:21 PM | fiint.h |
| 14,109 | Jun. 7, 2002 | 9:50 AM | iidcapi.h |
| 2,337 | Aug. 16, 2002 | 11:34 AM | SonyIIDC.h |
| 3,881 | Nov. 18, 2002 | 9:45 AM | sonyiidcdoc.h |
| 1,749 | Aug. 16, 2002 | 11:44 AM | SonyIIDCView.h |
| 296 | Jun. 13, 2001 | 4:15 PM | StdAfx.cpp |
| 813 | Aug. 10, 2006 | 11:10 AM | StdAfx.h |
| 91,058 | Jan. 20, 2010 | 2:44 PM | CLCDLL.cpp |
| 887 | Jun. 4, 2009 | 9:44 AM | cicdll.def |
| 8,848 | Nov. 29, 2005 | 2:05 PM | cicdll.h |
| 3,491 | Jan. 25, 2001 | 5:21 PM | Encdr2.h |
| 8,070 | Jan. 25, 2001 | 5:04 PM | Grabber.c |
| 7,733 | Jan. 19, 1998 | 6:32 PM | Grabber.h |
| 293 | Nov. 27, 2000 | 1:56 PM | StdAfx.cpp |
| 1,054 | Nov. 27, 2000 | 3:34 PM | StdAfx.h |

What is claimed is:

1. A process for measuring and controlling a color value of one or more colored image portions which are printed on a planar substrate, the process comprising:

(a) providing one or more colored image portions which are printed on a planar substrate, each colored image portion comprising one or more colors produced by one or more colored inks;

(b) providing one or more pairs of reference markers printed on the planar substrate in one or more ink zones and positioned adjacent to said one or more colored image portions, wherein each pair of reference markers comprises a primary reference marker and a secondary reference marker; wherein the primary reference marker comprises black ink and the secondary reference marker comprises one or more of cyan, magenta and yellow ink components; wherein each of said primary reference marker and said secondary reference marker has an ink density value, wherein said black, cyan, magenta and yellow inks each have an individual ink density value when present;

(c) providing at least one imaging assembly, wherein the imaging assembly is capable of capturing digital representations of each of said reference markers;

(d) controlling the positioning and linear movement of said imaging assembly across the planar substrate;

(e) selecting and acquiring a digital image with the imaging assembly of the primary reference marker and the secondary reference marker within one or more pairs of reference markers in at least one ink zone;

(f) analyzing the digital image of the primary reference marker and the secondary reference marker of each imaged reference marker pair to determine the ink density value for each reference marker within each imaged reference marker pair and the individual ink density values for each ink component of each reference marker;

(g) comparing the ink density value of the primary reference marker and the ink density value of the secondary reference marker of each imaged reference marker pair and determining any difference between the ink density value of said primary reference marker and the ink density value of said secondary reference marker of said imaged reference marker pair, and optionally storing said difference in a memory;

(h) optionally comparing the ink density value of the primary reference marker and/or the ink density value of the secondary reference marker of each imaged reference marker pair with a target ink density value for at least a portion of the one or more colored image portions on the substrate in at least one ink zone, and determining any difference between the ink density value of the primary reference marker and/or the ink density value of the secondary reference marker of each imaged reference marker pair and the target ink density value for the at least a portion of the one or more colored image portions on the substrate in at least one ink zone, and optionally storing said difference in a memory;

(i) optionally adjusting the ink quantity of black and/or colored ink being printed onto the substrate such that the ink density value of the primary reference marker in a reference marker pair is equivalent to the ink density value of the secondary reference marker in said reference marker pair, and/or such that the ink density value of the primary reference marker and/or the ink density value of the secondary reference marker in a reference marker pair is equivalent to the ink density value of a manually specified ink density value, and/or such that the ink density value of the primary reference marker and/or the ink density value of the secondary reference marker in a reference marker pair is equivalent to the target ink density value for at least a portion of the one or more colored image portions on the substrate in at least one ink zone; and (j) optionally repeating steps (d)-(i) for at least one of any additional ink zones.

2. The process of claim 1 wherein the secondary reference marker comprises cyan, magenta and yellow ink components and wherein the ink density value of the secondary reference marker equals the combined individual ink density values of the cyan, magenta and yellow ink components.

3. The process of claim 1 wherein the option of adjusting the ink quantity on the substrate in step (i) is performed.

4. The process of claim 3 further comprising conducting steps (d) through (i) to determine and compare the individual ink density values for each of said cyan, magenta and yellow inks of said secondary reference marker and adjusting the ink quantity of colored ink being printed onto the substrate such that all three of said individual ink density values are equivalent to each other within said secondary reference marker, and optionally further comparing the individual ink density values for each of said cyan, magenta and yellow inks of said secondary reference marker with the target ink density values of cyan, magenta and yellow inks in at least a portion of the one or more colored image portions on the substrate in at least one ink zone, and adjusting the ink quantity of colored ink being printed onto the substrate such that all three of said individual ink density values in said at least a portion of the one or more colored image portions on the substrate in at least one ink zone are equivalent to each corresponding individual ink density value within said secondary reference marker.

5. The process of claim 3 comprising adjusting the ink quantity on the substrate to change the ink density of the primary reference marker, and thereafter changing the individual ink density values of the cyan, magenta and yellow inks in said secondary reference marker to approximately match the ink density value of the primary reference marker.

6. The process of claim 3 wherein the planar substrate is moving and one or more colored image portions are continuously printed on the planar substrate, and wherein said ink quantity adjustment is stopped if color fringes are detected around the edges of the reference markers.

7. The process of claim 1 wherein the one or more colored image portions are printed on the planar substrate in a plurality of ink zones that extend across a width of the substrate, wherein one pair of reference markers is printed in each ink zone.

8. The process of claim 1 wherein said imaging assembly comprises a digital camera and at least one illumination source.

9. The process of claim 8 wherein the illumination source either continuously or intermittently illuminates the one or more colored image portions.

10. The process of claim 8 wherein the illumination source comprises a strobe comprising one or more white light emitting diodes.

11. The process of claim 8 wherein said image acquiring is conducted by:

(I) illuminating the substrate at the one or more pairs of reference markers with the at least one illumination source; and (II) capturing a digital image of the one or more pairs of reference markers with the digital camera.

12. The process of claim 11 wherein the planar substrate is moving and one or more colored image portions are continuously printed on the planar substrate, and the illumination source and digital camera move together across the substrate perpendicular to the direction of travel of the substrate.

13. The process of claim 8 wherein the planar substrate is stationary and the illumination source and digital camera move together in two orthogonal directions relative to a surface of the planar substrate.

14. The process of claim 1 wherein the one or more colored image portions are printed on the planar substrate in a plurality of ink zones that extend across a width of the substrate and wherein said adjusting step (i) is performed by adjusting an ink control mechanism to change the amount of ink printed onto the substrate in one or more of said ink zones, thereby modifying the one or more colored image portions printed on the planar substrate.

15. The process of claim 1 further comprising presenting a visual representation of the one or more colored image portions, the one or more pairs of reference markers, the primary reference marker, the secondary reference marker, the ink density values of said markers, a comparison of the ink density values, or combinations thereof, on a display screen.

16. The process of claim 1 wherein the primary reference marker is a halftone printed with black ink only.

17. The process of claim 1 wherein the ink density value of the primary reference marker is equivalent to the ink density value of the secondary reference marker, and said primary reference marker is a halftone printed with black ink only.

18. The process of claim 1 wherein the primary reference marker and the secondary reference marker are differentiated from other print on the substrate by their geometry and/or their spatial orientation.

19. The process of claim 1 wherein a position marker is printed on the substrate relative to said primary reference marker and said secondary reference marker, the process further comprising verifying the lateral position of the primary reference marker and/or the secondary reference marker on the substrate relative to a location of the position marker.

20. A process for controlling an amount of ink fed from a plurality of inking units in a multicolored printing press onto a planar substrate fed through the press, which substrate is in a web or sheet form, said substrate having one or more colored image portions printed thereon from the inking units, which image portions are printed across a width of the substrate in one or more ink zones, each colored image portion comprising one or more colors, wherein each color has an individual color value, the system being capable of functioning in the presence of or absence of a color bar, the process comprising:

(a) providing one or more colored image portions which are printed on a planar substrate, each colored image portion comprising one or more colors produced by one or more colored inks;

(b) determining whether a color bar is printed on the planar substrate, which color bar comprises a plurality of color patches, wherein at least one color patch is printed in each ink zone, wherein each color patch comprises one or more color layers; and determining whether one or more pairs of reference markers are printed on the planar substrate adjacent to said one or more colored image portions and in one or more ink zones, wherein each pair of reference markers comprises a primary reference marker and a secondary reference marker; wherein the primary reference marker comprises black ink and the secondary reference marker comprises one or more of cyan, magenta and yellow ink components; wherein each of said primary reference marker and said secondary reference marker has an ink density value, wherein said black, cyan, magenta and yellow inks each have an individual ink density value when present, and wherein the ink density value of the secondary reference marker optionally equals the combined individual ink density values of the cyan, magenta and yellow inks;

(c) if one or more pairs of reference markers are present, conducting step (I), and if a color bar is present, but no reference markers are present, conducting step (II):

(I) (i) providing at least one imaging assembly, wherein the imaging assembly is capable of capturing digital representations of each of said reference markers;

(ii) controlling the positioning and linear movement of said imaging assembly across the planar substrate;

(iii) selecting and acquiring a digital image with the imaging assembly of the primary reference marker and the secondary reference marker within one or more pairs of reference markers in at least one ink zone;

(iv) analyzing the digital image of the primary reference marker and the secondary reference marker of each imaged reference marker pair to determine the ink density value for each reference marker within each imaged reference marker pair and the individual ink density values for each ink component of each reference marker;

(v) comparing the ink density value of the primary reference marker and the ink density value of the secondary reference marker of each imaged reference marker pair and determining any difference between the ink density value of said primary reference marker and the ink density value of said secondary reference marker of said imaged reference marker pair, and optionally storing said difference in a memory;

(vi) optionally comparing the ink density value of the primary reference marker and/or the ink density value of the secondary reference marker of each imaged reference marker pair with a target ink density value for at least a portion of the one or more colored image portions on the substrate in at least one ink zone, and determining any difference between the ink density value of the primary reference marker and/or the ink density value of the secondary reference marker of each imaged reference marker pair and the target ink density value for the at least a portion of the one or more colored image portions on the substrate in at least one ink zone, and optionally storing said difference in a memory;

(vii) optionally adjusting the ink quantity of black and/or colored ink being printed onto the substrate such that the ink density value of the primary reference marker in a reference marker pair is equivalent to the ink density value of the secondary reference marker in said reference marker pair, and/or such that the ink density value of the primary reference marker and/or the ink density value of the secondary reference marker in a reference marker pair is equivalent to the ink density value of a manually specified ink density value, and/or such that the ink density value of the primary reference marker and/or the ink density value of the secondary reference marker in a reference marker pair is equivalent to the target ink density value for at least a portion of the one or more colored image portions on the substrate in at least one ink zone; and (viii) optionally repeating steps (ii)-(vii) for at least one of any additional ink zones;

(II) (i) providing at least one imaging assembly, wherein the imaging assembly is capable of capturing digital representations of each of said reference markers;

(ii) controlling the positioning and linear movement of said imaging assembly across the planar substrate;

(iii) selecting and acquiring a digital image with the imaging assembly of one or more color patches in a first ink zone;

(iv) analyzing the acquired digital image of the one or more color patches to determine an actual ink density value for each color patch;

(v) comparing the actual ink density values of each color patch to a target ink density value for each color patch and determining any difference between the actual ink density value and the target ink density value for each color patch, and optionally storing said difference in a memory; and (vi) optionally adjusting the ink quantity being printed on the substrate such that the actual ink density value of the one or more color patches in the first ink zone is equivalent to the target ink density value for each corresponding color patch; and (vii) optionally repeating steps (ii)-(vi) for at least one additional color patch in at least one of any additional ink zones.

* * * * *